US011580896B2

(12) United States Patent
Lim et al.

(10) Patent No.: US 11,580,896 B2
(45) Date of Patent: Feb. 14, 2023

(54) ELECTROLUMINESCENCE DISPLAY APPARATUS FOR COMPENSATING LUMINANCE DEVIATION

(71) Applicant: LG Display Co., Ltd., Seoul (KR)

(72) Inventors: Myung Gi Lim, Ansan-si (KR); Tae Young Lee, Seoul (KR); Ji Su Choi, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/469,649

(22) Filed: Sep. 8, 2021

(65) Prior Publication Data

US 2022/0122525 A1 Apr. 21, 2022

(30) Foreign Application Priority Data

Oct. 16, 2020 (KR) ..... 10-2020-0134254

(51) Int. Cl.
*G09G 3/32* (2016.01)

(52) U.S. Cl.
CPC ..... *G09G 3/32* (2013.01); *G09G 2300/0413* (2013.01); *G09G 2300/0861* (2013.01); *G09G 2310/0294* (2013.01); *G09G 2310/08* (2013.01); *G09G 2320/0233* (2013.01)

(58) Field of Classification Search
CPC ... G09G 3/32–3291; G09G 2300/0413; G09G 2300/0861; G09G 2310/0243; G09G 2310/0281; G09G 2310/0289–0294; G09G 2310/06; G09G 2310/08; G09G 2320/0233; G09G 2320/0242; G09G 2320/029; G09G 2320/0295; G09G 2320/043; G09G 2320/045; G09G 2320/0693; G09G 2330/10; G09G 2330/12

See application file for complete search history.

(56) References Cited

U.S. PATENT DOCUMENTS

2015/0379909 A1* 12/2015 Yu ..... G09G 3/006 345/78
2019/0130813 A1* 5/2019 Fang ..... G09G 3/2092
2020/0202787 A1* 6/2020 Do ..... G09G 3/3233
2020/0348786 A1* 11/2020 Jun ..... G06F 3/04166

FOREIGN PATENT DOCUMENTS

KR 10-2018-0014389 A 2/2018

* cited by examiner

*Primary Examiner* — Nathan Danielsen
(74) *Attorney, Agent, or Firm* — Seed IP Law Group LLP

(57) ABSTRACT

An electroluminescence display apparatus includes a display panel including a first pixel and a second pixel, a first current integrator connected to the first pixel through a first sensing channel to sense a first current from the first pixel to generate a first output voltage, a second current integrator connected to the second pixel through a second sensing channel to sense a second current from the second pixel to generate a second output voltage, and a sampling capacitor connected to an output terminal of the first current integrator at one electrode thereof and connected to an output terminal of the second current integrator at the other electrode thereof, thereby sampling the first output voltage and the second output voltage.

21 Claims, 19 Drawing Sheets

| COMPONENT | RELATED ART | PRESENT DISCLOSURE (FIG. 7) | PRESENT DISCLOSURE (FIG. 9) |
|---|---|---|---|
| VALID SENSING CHANNEL | 120 | 120 | 120 |
| DUMMY SENSING CHANNEL | 120 | 1 | 1 |
| SAMPLING CAPACITOR | 240 | 120 | 240 |
| SCALER | 240 | 120 | 120 |

| COMPONENT | RELATED ART | PRESENT DISCLOSURE (FIG. 14) | PRESENT DISCLOSURE (FIG. 20) |
|---|---|---|---|
| VALID SENSING CHANNEL | 120 | 120 | 120 |
| DUMMY SENSING CHANNEL | 120 | 1 | 1 |
| SAMPLING CAPACITOR | 240 | 120 | 240 |
| SCALER | 240 | 120 | 120 |

ELECTROLUMINESCENCE DISPLAY APPARATUS FOR COMPENSATING LUMINANCE DEVIATION

CROSS-REFERENCE TO RELATED APPLICATION

This application claims the benefit of Korean Patent Application No. 10-2020-0134254, filed on Oct. 16, 2020, which is hereby incorporated by reference as if fully set forth herein.

BACKGROUND

Technical Field

The present disclosure relates to an electroluminescence display apparatus.

Description of the Related Art

In electroluminescence display apparatuses having an active matrix type, a plurality of pixels each including a light emitting device and a driving element are arranged as a matrix type, and the luminance of an image implemented by the pixels is adjusted based on a gray level of image data. The driving element controls a pixel current flowing in the light emitting device on the basis of a voltage (hereinafter referred to as a gate-source voltage) applied between a gate electrode and a source electrode thereof. The amount of light emitted by the light emitting device and the luminance of a screen are determined based on a pixel current.

A threshold voltage and electron mobility of the driving element and an operating point voltage (or a turn-on voltage) of the light emitting device determine a driving characteristic of a pixel and thus should be constant in all pixels, but a driving characteristic between pixels may be changed by various causes such as a process characteristic and a degradation characteristic. Such a driving characteristic difference causes a luminance deviation, and due to this, there is a limitation in implementing an image.

Compensation techniques for compensating for a luminance deviation between pixels has been proposed.

BRIEF SUMMARY

The inventors of the present disclosure have recognized that the proposed compensation techniques do not perform well due to noise issue in a sensing process. To overcome the aforementioned problem of the related art and other various technical problems, the present disclosure may provide an electroluminescence display apparatus which increases compensation performance by removing noise occurring in a sensing process.

To achieve these objects and other advantages and in accordance with the purpose of the disclosure, as embodied and broadly described herein, an electroluminescence display apparatus includes a display panel including a first pixel and a second pixel, a first current integrator connected to the first pixel through a first sensing channel to sense a first current from the first pixel to generate a first output voltage, a second current integrator connected to the second pixel through a second sensing channel to sense a second current from the second pixel to generate a second output voltage, and a sampling capacitor connected to an output terminal of the first current integrator at one electrode thereof and connected to an output terminal of the second current integrator at the other electrode thereof, thereby sampling the first output voltage and the second output voltage.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
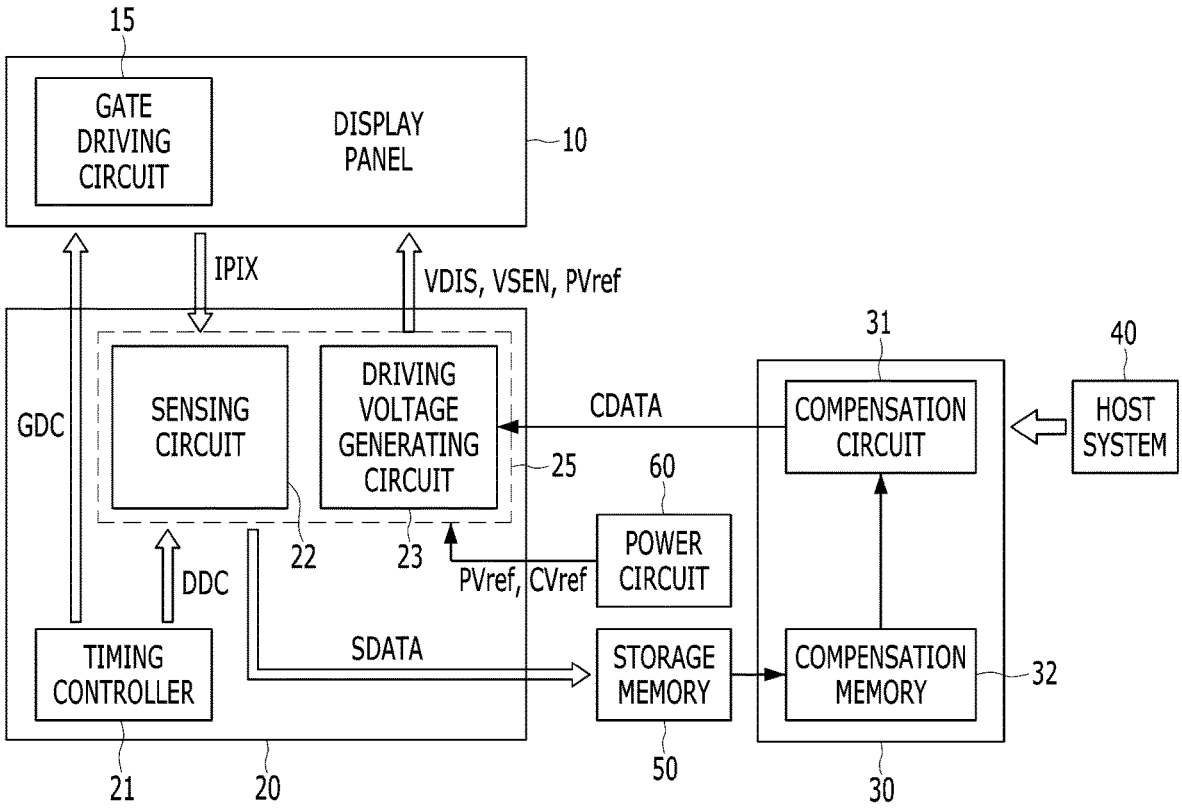
FIG. 1 is a diagram illustrating an electroluminescence display apparatus according to an embodiment of the present disclosure.

Hereinafter, the present disclosure will be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art.

The shapes, sizes, ratios, angles, numbers and the like disclosed in the drawings for description of various embodiments of the present disclosure to describe embodiments of the present disclosure are merely exemplary and the present disclosure is not limited thereto. Like reference numerals refer to like elements throughout. Throughout this specification, the same elements are denoted by the same reference numerals. As used herein, the terms "comprise," "having," "including" and the like suggest that other parts can be added unless the term "only" is used. As used herein, the singular forms "a," "an," and "the" are intended to include the plural forms as well, unless context clearly indicates otherwise.

Elements in various embodiments of the present disclosure are to be interpreted as including margins of error even without explicit statements.

In describing a position relationship, for example, when a position relation between two parts is described as "on~," "over~." "under~," and "next~," one or more other parts may be disposed between the two parts unless "just" or "direct" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Like reference numerals refer to like elements throughout.

In the specification, a pixel circuit provided on a substrate of a display panel may be implemented with a thin film transistor (TFT) having an n-type metal oxide semiconductor field effect transistor (MOSFET) structure, but is not limited thereto and may be implemented with a TFT having a p-type MOSFET structure. A TFT may be a three-electrode element which includes a gate, a source, and a drain. The source may be an electrode which supplies a carrier to a transistor. In the TFT, a carrier may start to flow from the source. The drain may be an electrode which enables the carrier to flow out from the TFT. That is, in a MOSFET, the carrier flows from the source to the drain. In the n-type TFT (NMOS), because a carrier is an electron, a source voltage may have a lower voltage than a drain voltage so that the electron flows from the source to the drain. In the n-type TFT, because the electron flows from the source to the drain, a current may flow from the drain to the source. On the other hand, in the p-type TFT (PMOS), because a carrier is a hole, a source voltage may be higher than a drain voltage so that the hole flows from the source to the drain. In the p-type TFT, because the hole flows from the source to the drain, a current may flow from the source to the drain. It should be noted that a source and a drain of a MOSFET are not fixed but switch therebetween. For example, the source and the drain of the MOSFET may switch therebetween.

Moreover, in the present disclosure, a semiconductor layer of a TFT may be implemented with at least one of an oxide element, an amorphous silicon element, and a polysilicon element.

In the following description, when the detailed description of the relevant known function or configuration is determined to unnecessarily obscure the important point of the present disclosure, the detailed description will be omitted. Hereinafter, embodiments of the present disclosure will be described in detail with reference to the accompanying drawings.

Figure 2:
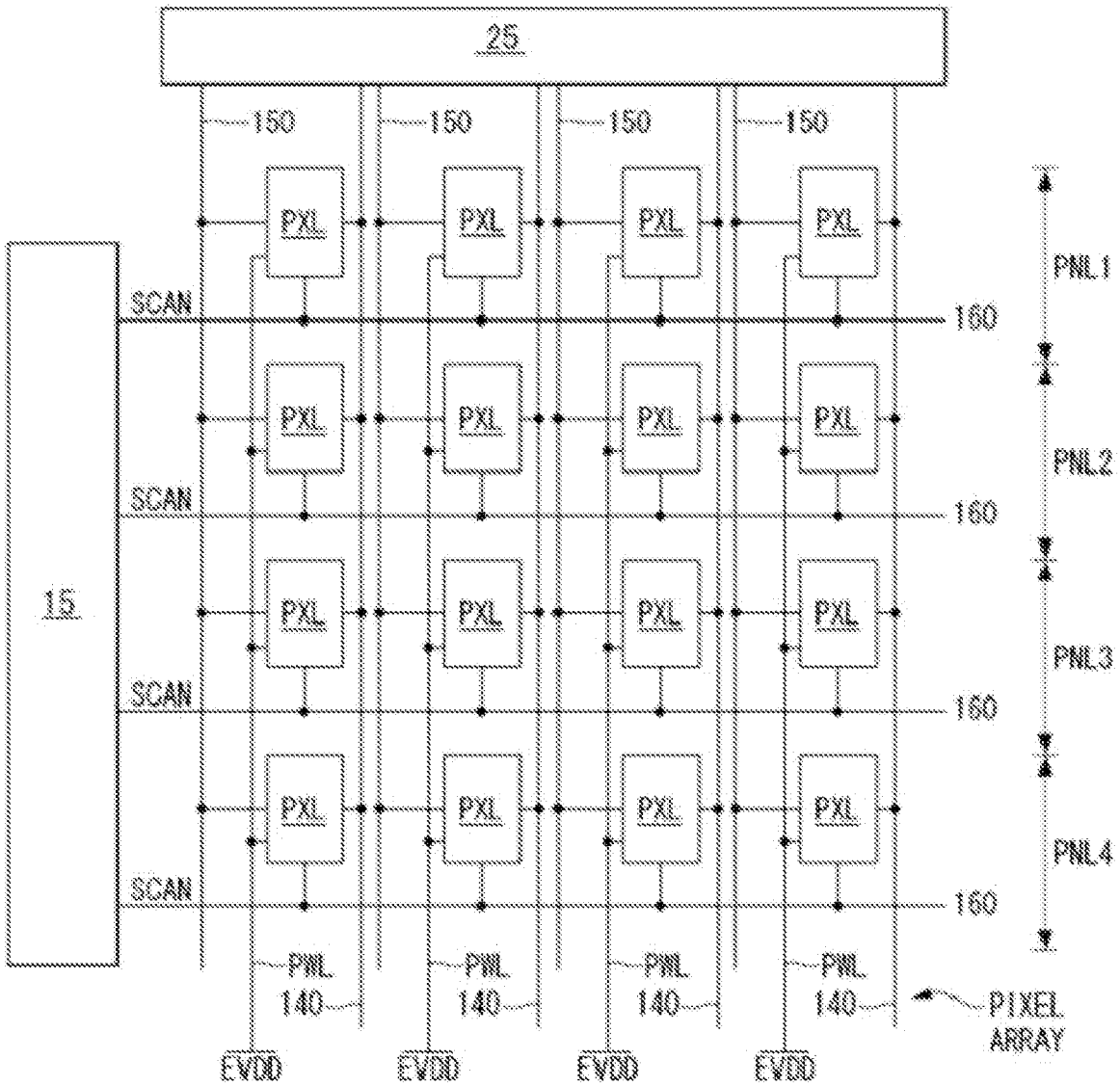
FIG. 2 is a diagram illustrating an example of a pixel array included in a display panel of FIG. 1.

FIG. 1 is a diagram illustrating an electroluminescence display apparatus according to an embodiment of the present disclosure. FIG. 2 is a diagram illustrating an example of a pixel array included in a display panel of FIG. 1.

Referring to FIGS. 1 and 2, the electroluminescence display apparatus according to an embodiment of the present disclosure may include a display panel 10, a driver integrated circuit (IC) 20, a compensation IC 30, a host system 40, a storage memory 50, and a power circuit 60. A panel driving circuit for driving the display panel 10 may include a gate driving circuit 15 included in the display panel 10 and a data driving circuit 25 embedded into the driver IC 20.

The display panel 10 may include a plurality of pixel lines PNL1 to PNL4, and each of the pixel lines PNL1 to PNL4 may include a plurality of pixels PXL and a plurality of signal lines. A "pixel line" described herein may not be a physical signal line and may denote a set of signal lines and pixels PXL adjacent to one another in an extension direction of a gate line. The signal lines may include a plurality of data lines 140 for supplying a display data voltage VDIS and a sensing data voltage VSEN, a plurality of reference voltage lines 150 for supplying a pixel reference voltage PVref to the pixels PXL, a plurality of gate lines 160 for supplying a gate signal to the pixels PXL, and a plurality of high level power lines PWL for supplying a high level pixel voltage to the pixels PXL.

The pixel PXL of the display panel 10 may be arranged as a matrix type to configure a pixel array. Each pixel PXL included in the pixel array of FIG. 2 may be connected to one of the data lines 140, one of the reference voltage lines 150, one of the high level power lines PWL, and one of the gate lines 160. Each pixel PXL included in the pixel array of FIG. 2 may be connected to the plurality of gate lines 160. Also, each pixel PXL included in the pixel array of FIG. 2 may be further supplied with a low level pixel voltage from the power circuit 60. The power circuit 60 may supply a low level pixel voltage to a pixel PXL through a low level power line or a pad part.

The gate driving circuit 15 may be embedded into the display panel 10. The gate driving circuit 15 may be disposed in a non-display area outside a display area where the pixel array is provided.

The gate driving circuit 15 may include a plurality of gate stages connected to the gate lines 160 of the pixel array. The gate stages may generate the gate signal for controlling switch elements of the pixels PXL and may supply the gate signal to the gate lines 160.

The driver IC 20 may include a timing controller 21 and the data driving circuit 25, but is not limited thereto. The timing controller 21 may not be included in the driver IC 20 and may be mounted on a control board along with the driver IC 20. The data driving circuit 25 may include a sensing circuit 22 and a driving voltage generating circuit 23, but is not limited thereto.

The timing controller 21 may generate a gate timing control signal GDC for controlling an operation timing of the gate driving circuit 15 and a data timing control signal DDC for controlling an operation timing of the data driving circuit 25 with reference to timing signals (for example, a vertical synchronization signal Vsync, a horizontal synchronization signal Hsync, a dot clock signal DCLK, and a data enable signal DE) input from a host system 40.

The data timing control signal DDC may include a source start pulse, a source sampling clock, and a source output enable signal, but is not limited thereto. The source start pulse may control a data sampling start timing of the driving voltage generating circuit 23. The source sampling clock may be a clock signal for controlling a sampling timing of data with respect to a rising or falling edge. The source output enable signal may control an output timing of the driving voltage generating circuit 23.

The gate timing control signal GDC may include a gate start signal and a gate shift clock, but is not limited thereto. The gate start pulse may be applied to a gate stage which generates a first gate output and may activate an operation of the gate stage. The gate shift clock may be input to the gate stages in common and may be a clock signal for shifting the gate shift pulse.

The timing controller 21 may control an operating timing of the panel driving circuit, and thus, may sense a driving characteristic of the pixels PXL in at least one of a power-on period, a vertical active period of each frame, a vertical blank period of each frame, and a power-off period. Here, the power-on period may be a period until before a screen is turned on after a system power is applied, and the power-off period may be a period until before the system power is released after the screen is turned off. The vertical active period may be a period where image data is applied to the display panel 10 so as to reproduce an image, and the vertical blank period may be a period which is disposed between adjacent vertical active periods and where the applying of the image data stops. A driving characteristic of the pixels PXL may include one or more of a threshold voltage and electron mobility of the driving element included in each pixel PXL and an operating point voltage of the light emitting device included in each pixel PXL.

The timing controller 21 may control a sensing driving timing and a display driving timing of the pixel lines PNL1 to PNL4 of the display panel 10 on the basis of a predetermined sequence, and thus, may implement a display driving operation and a sensing driving operation.

The timing controller 21 may differently generate timing control signals GDC and DDC for the display driving operation and timing control signals GDC and DDC for the sensing driving operation. The sensing driving operation may denote an operation which applies the sensing data voltage VSEN to pixels PXL included a sensing target pixel line to sense a driving characteristic of corresponding pixels PXL and updates a compensation value for compensating for a driving characteristic variation of the corresponding pixels PXL on the basis of sensing result data SDATA. Also, the display driving operation may denote an operation which corrects digital image data, which is to be input to corresponding pixels PXL, on the basis of an updated compensation value and applies the display data voltage VDIS corresponding to corrected image data CDATA to the corresponding pixels PXL to display an input image.

The driving voltage generating circuit 23 may be implemented as a digital-to-analog converter (DAC) which converts a digital signal into an analog signal. The driving voltage generating circuit 23 may generate the sensing data voltage VSEN needed for the sensing driving operation and the display data voltage VDIS needed for the display driving operation and supplies the sensing data voltage VSEN and the display data voltage VDIS to the data lines 140. The display data voltage VDIS may be a digital-to-analog conversion result of the corrected digital image data CDATA obtained through correction by the compensation IC 30 and may have a level which varies by pixel units on the basis of a grayscale value and a compensation value. The sensing data voltage VSEN may be differently set in red (R), green (G), blue (B), and white (W) pixels on the basis of that a driving characteristic of the driving element differs for each color.

The sensing circuit 22 may sense the driving characteristic of the pixels PXL through a plurality of sensing channels, for the sensing driving operation. The sensing channels may be connected to the pixels PXL through the sensing lines. The sensing lines may be implemented as the reference voltage lines 150, but are not limited thereto. The sensing circuit 22 may be implemented as a current sensing type which senses a pixel current flowing in each pixel PXL and removes noise occurring in the pixel current. The sensing circuit 22 may be variously implemented for removing noise and may prevent panel noise and power noise from being reflected in sensing result data SDATA, thereby increasing compensation performance.

The sensing circuit 22 may simultaneously perform a parallel processing operation on a plurality of analog sensing values by using a plurality of analog-to-digital converters (ADCs) and may sequentially perform a serial processing operation on the plurality of analog sensing values by using one ADC. The ADC may convert the analog sensing values into the digital sensing result data SDATA on the basis of a predetermined sensing range, and then, may store the digital sensing result data SDATA in the storage memory 50.

The storage memory 50 may store digital sensing result data SDATA input from the sensing circuit 22 in performing the sensing driving operation. The storage memory 50 may be implemented as flash memory, but is not limited thereto.

The compensation IC 30 may include a compensation circuit 31 and a compensation memory 32. The compensation memory 32 may transfer the digital sensing result data SDATA, read from the storage memory 50, to the compensation circuit 31. The compensation memory 32 may be random access memory (RAM) (for example, double data rate synchronous dynamic RAM (DDR SDRAM), but is not limited thereto. The compensation circuit 31 may calculate a compensation offset and a compensation gain for each pixel on the basis of the digital sensing result data SDATA read from the storage memory 50, correct image data input from the host system 40 on the basis of the calculated compensation offset and compensation gain, and supply the corrected image data CDATA to the driver IC 20.

The power circuit 60 may generate a pixel reference voltage PVref and an integrator reference voltage CVref and may supply the pixel reference voltage PVref and the integrator reference voltage CVref to the driver IC 20. The pixel reference voltage PVref may be supplied to the pixels PXL of the display panel 10 through the data driving circuit 25, but is not limited thereto. The pixel reference voltage PVref may be directly supplied to the pixels PXL of the display panel 10 without passing through the data driving circuit 25. The integrator reference voltage CVref may be supplied to the sensing circuit 22.

Figure 3:
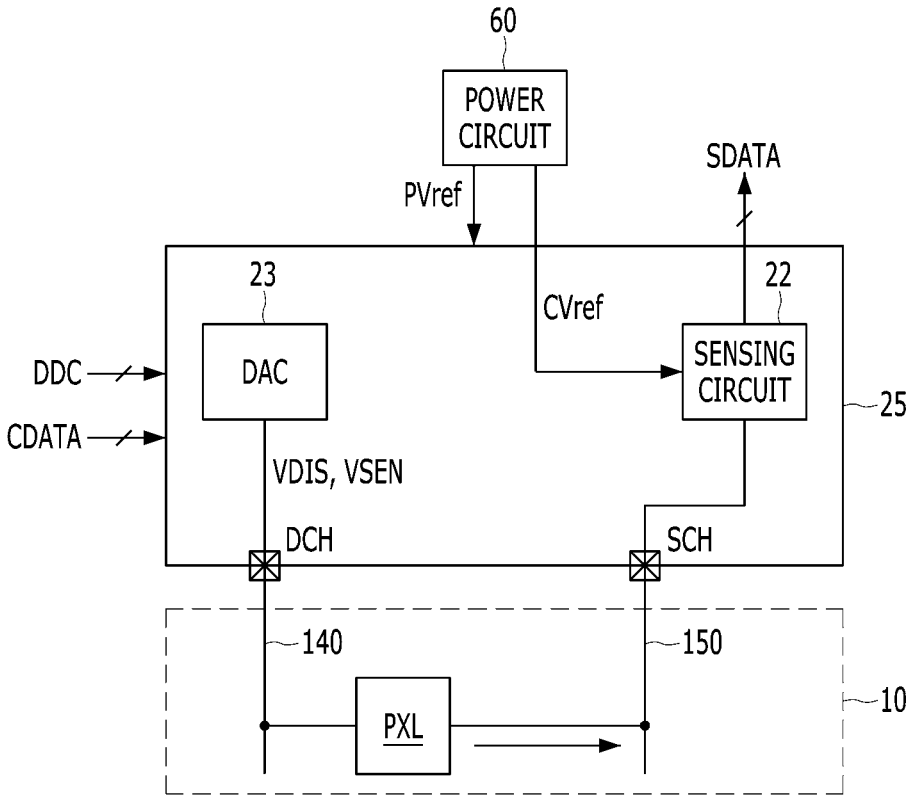
FIG. 3 is a diagram illustrating a configuration of a data driver connected to the pixel array of FIG. 2.

FIG. 3 is a diagram illustrating a configuration of the data driving circuit 25 connected to the pixel array of FIG. 2. The data driving circuit 25 of FIG. 3 may be for sensing the driving characteristic of the pixels PXL through the reference voltage lines 150. Each of the reference voltage lines 150 may be connected to a sensing channel SCH of the data driving circuit 25 and may perform a function of the sensing line.

Referring to FIG. 3, the data driving circuit 25 may be connected to a first node of the pixel PXL (connected to a gate electrode of the driving element) through the data line 140 and may be connected to a second node of the pixel PXL (connected to a source electrode of the driving element) through the reference voltage line 150. An on current or an off current may flow in the second node of the pixel PXL, and thus, the reference voltage line 150 connected to the second node through a second switch element may act as a sensing line.

The data driving circuit 25 may include the driving voltage generating circuit 23 and the sensing circuit 22. The driving voltage generating circuit 23 may be connected to the data line 140 of the display panel 10 through a data channel DCH, and the sensing circuit 22 may be connected to the reference voltage line 150 of the display panel 10 through a sensing channel SCH. The driving voltage generating circuit 23 may generate the sensing data voltage VSEN and the display data voltage VDIS by using the DAC. The sensing data voltage VSEN may include an on voltage and an off voltage. The on voltage may be a voltage for turning on the driving element of the pixel PXL, and the off voltage may be a voltage for turning off the driving element of the pixel PXL. The off voltage may be a voltage close to a black gray level.

The sensing channel SCH may supply the pixel reference voltage PVref to the reference voltage line 150 in performing the display driving operation. The sensing channel SCH may supply the integrator reference voltage CVref to the reference voltage line 150 in an initialization period of the sensing driving operation. Also, the sensing channel SCH may be a current path which transfers an on current or an off current, applied through the reference voltage line 150, to the sensing circuit 22 in a sensing period of the sensing driving operation.

A number of sensing channels SCH equal to the number of reference voltage lines 150 may be provided. The sensing channel SCH may include a valid sensing channel through which a pixel current IPIX and panel noise flow in and a dummy sensing channel through which the panel noise flows in. The valid sensing channel may be connected to a valid pixel where the on current flows, and the dummy sensing channel may be connected to a dummy pixel where the off current flows. In the same sensing block, a plurality of valid sensing channels may share one dummy sensing channel.

The sensing circuit 22 may include a plurality of sampling capacitors connected between each of the valid sensing channels and the dummy sensing channel, and thus, may remove power noise as well as the panel noise. The power noise may include a variation of the integrator reference voltage CVref and an offset variation of a current integrator. Each of the sampling capacitors may not be connected to a separate reference voltage source and may be connected between output terminals of two current integrators corresponding to the valid sensing channel and the dummy sensing channel, and thus, may effectively remove the power noise as well as the panel noise.

Figure 4:
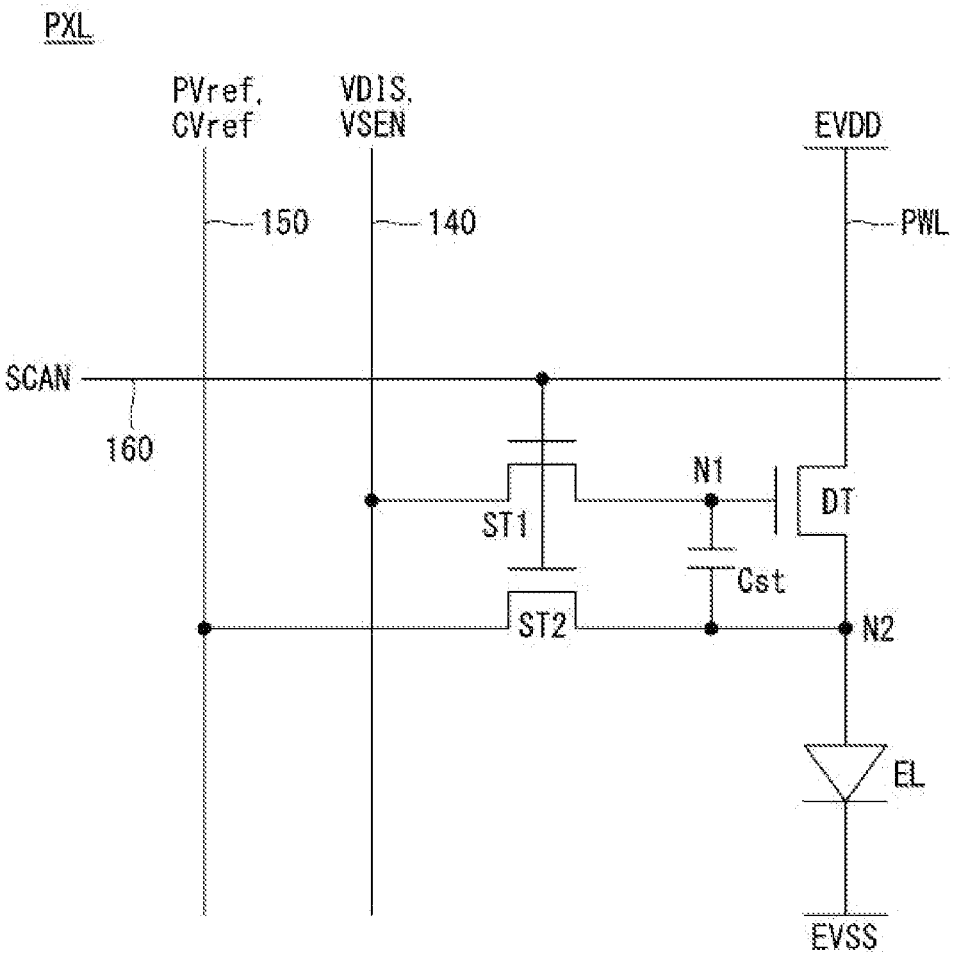
FIG. 4 is an equivalent circuit diagram of a pixel illustrated in FIG. 3.

FIG. 4 is an equivalent circuit diagram of the pixel illustrated in FIG. 3.

FIG. 4 illustrates one pixel PXL which uses the reference voltage line 150 as a sensing line. However, it should be noted that the technical spirit of the present disclosure is not limited to a pixel structure of FIG. 4. The technical spirit of the present disclosure may be applied to a pixel structure which uses the data line 140 as a sensing line.

Referring to FIG. 4, the one pixel PXL may include a light emitting device EL, a driving thin film transistor (TFT) DT, a plurality of switch TFTs ST1 and ST2, and a storage capacitor Cst. The driving TFT DT and the switch TFTs ST1 and ST2 may each be implemented as an NMOS transistor, but are not limited thereto.

The light emitting device EL may emit light with a pixel current supplied from the driving TFT DT. The light emitting device EL may be implemented as an organic light emitting diode including an organic light emitting layer, or may be implemented as an inorganic light emitting diode including an inorganic light emitting layer. An anode electrode of the light emitting device EL may be connected to a second node N2, and a cathode electrode thereof may be connected to an input terminal of a low level pixel voltage EVSS.

The driving TFT DT may be a driving element which generates a pixel current on the basis of a gate-source voltage. A gate electrode of the driving TFT DT may be connected to a first node N1, a first electrode thereof may be connected to an input terminal of a high level pixel voltage EVDD through a high level power line PWL, and a second electrode thereof may be connected to the second node N2.

The switch TFTs (for example, first and second TFTs) ST1 and ST2 may be switch elements which set the gate-source voltage of the driving TFT DT and connect the first electrode of the driving TFT DT to a data line 140 or connect the second electrode of the driving TFT DT to a reference voltage line 150.

The first switch TFT ST1 may be connected between the data line 140 and the first node N1 and may be turned on based on a gate signal SCAN transferred through a gate line 160. The first switch TFT ST1 may be turned on in programming for the display driving operation and may be turned on in an initialization period for the sensing driving operation. When the first switch TFT ST1 is turned on, a sensing data voltage VSEN or a display data voltage VDIS may be applied to the first node N1. A gate electrode of the first switch TFT ST1 may be connected to the gate line 160, a first electrode thereof may be connected to the data line 140, and a second electrode thereof may be connected to the first node N1.

The second switch TFT ST2 may be connected between the reference voltage line 150 and the second node N2 and may be turned on based on the gate signal SCAN transferred through the gate line 160. The second switch TFT ST2 may be turned on in programming for the display driving operation and may apply a pixel reference voltage PVref to the second node N2. The second switch TFT ST2 may be turned on in the initialization period for the sensing driving operation and may apply an integrator reference voltage CVref to the second node N2. Also, the second switch TFT ST2 may be turned on in a sensing period for the sensing driving operation and may transfer an on current or an off current to the reference voltage line 150. A gate electrode of the second switch TFT ST2 may be connected to the gate line 160, a first electrode thereof may be connected to the reference voltage line 150, and a second electrode thereof may be connected to the second node N2.

The storage capacitor Cst may be connected between the first node N1 and the second node N2 and may maintain a gate-source voltage of the driving TFT DT during a certain period.

Figure 5:
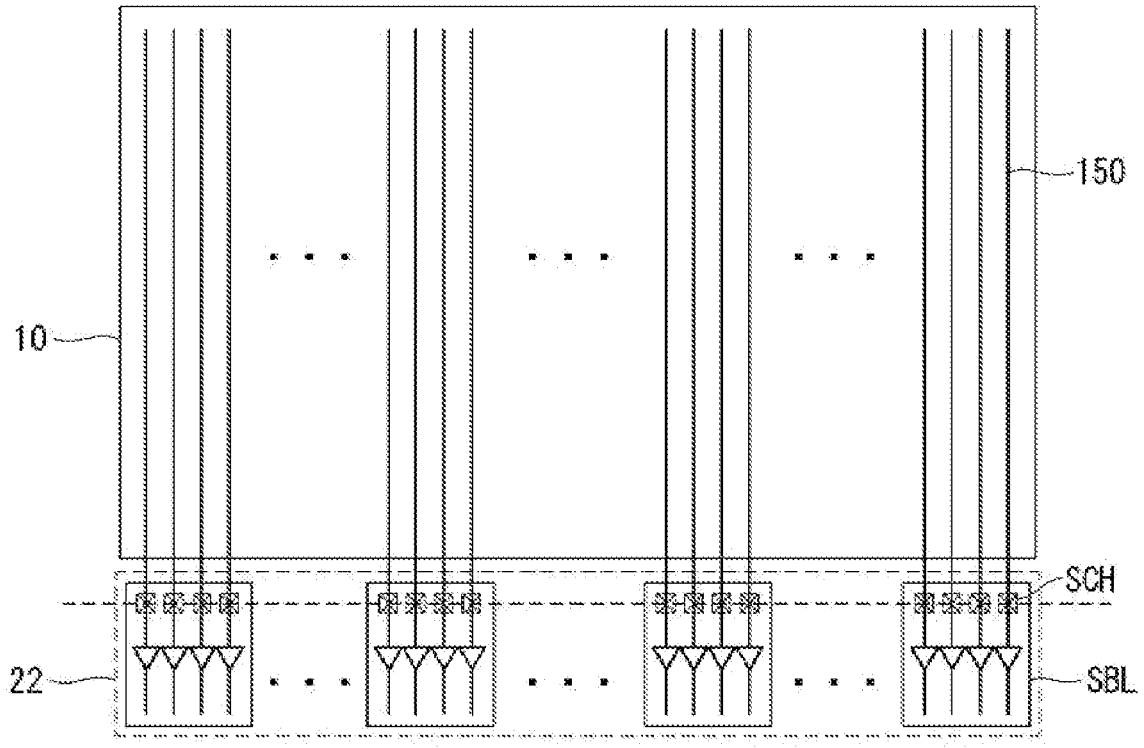
FIG. 5 is a diagram illustrating a plurality of sensing channels included in each sensing block.

FIG. 5 is a diagram illustrating a plurality of sensing channels included in each sensing block.

Referring to FIG. 5, a sensing circuit 22 may include one or more sensing blocks SBL. One sensing block SBL may be connected to a plurality of reference voltage lines 150 of a display panel 10 through a plurality of sensing channels SCH. One of the sensing channels SCH included in the one sensing block SBL may be a dummy sensing channel, and sensing channels other than the dummy sensing channel may be valid sensing channels.

Positions of the dummy sensing channel and the valid sensing channels may be fixed as in FIGS. 6 to 12. The positions of the dummy sensing channel and the valid sensing channels may be changed over time as in FIGS. 13 to 21.

First Embodiment

According to the first embodiment, sensing channels included in one sensing block may be simultaneously sampled once by using a sampling capacitor connected between each of valid sensing channels and a dummy sensing channel and noise-removed sampling voltages may be output, and thus, a size of a sensing circuit may decrease by half without an increase in a sensing time, with respect to one sensing block. According to the first embodiment, one sensing channel disposed at a specific position (i.e., a fixed position) among sensing channels included in one sensing block may be a dummy sensing channel, and sensing channels other than the dummy sensing channel may be valid sensing channels.

Figure 6:
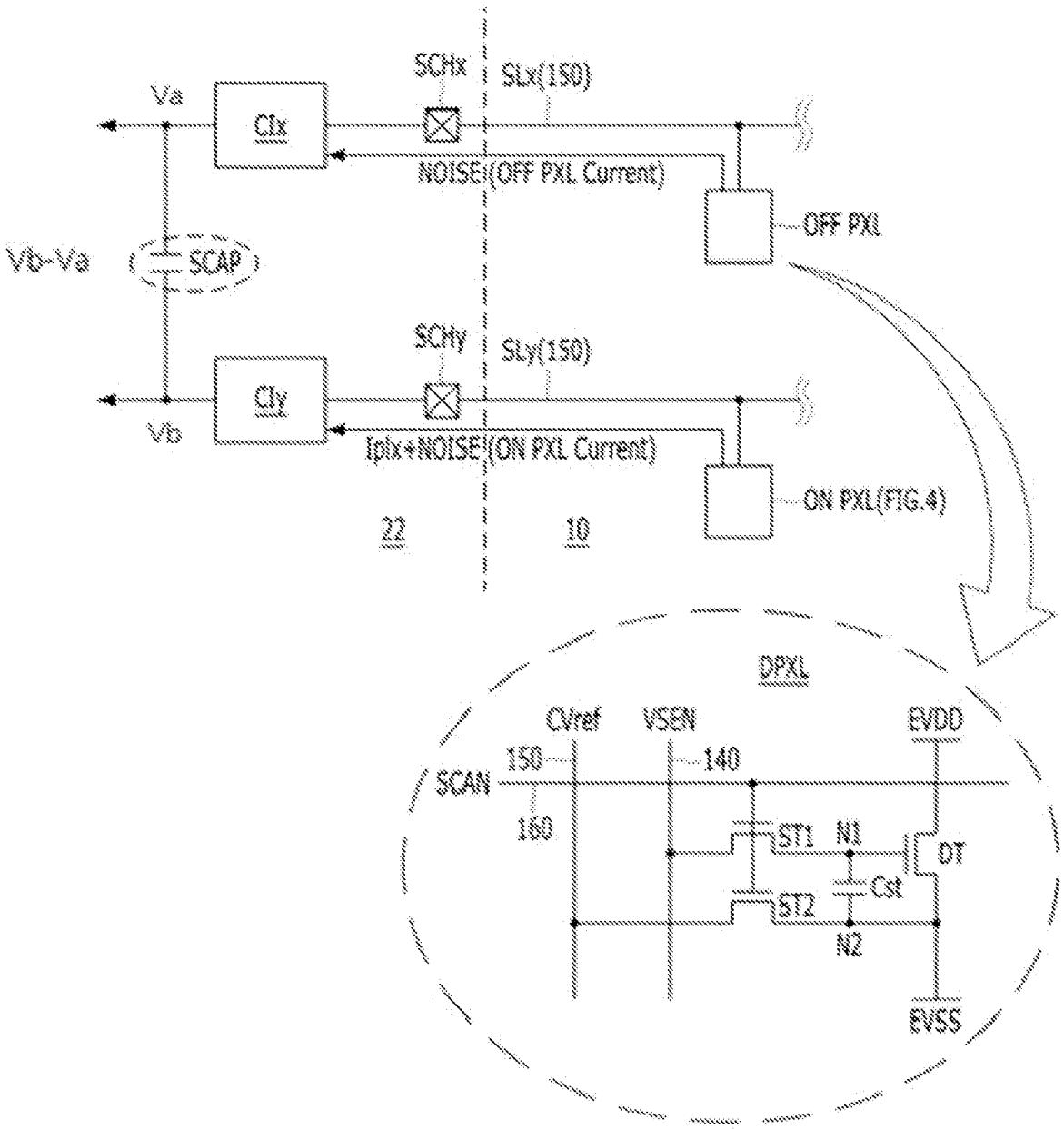
FIG. 6 is a schematic diagram of a connection configuration between a dummy sensing channel and a valid sensing channel in one sensing block, in a noise removing method according to a first embodiment.

FIG. 6 is a schematic diagram of a connection configuration between a dummy sensing channel and a valid sensing channel in one sensing block, in a noise removing method according to a first embodiment.

Referring to FIG. 6, a dummy sensing channel SCHx may be connected to a dummy pixel (an off pixel) through a dummy sensing line SLx, and the valid sensing channel SCHy may be connected to a valid pixel (an on pixel) through a valid sensing line SLy. The dummy sensing line SLx and the valid sensing line Sly may be different reference voltage supply lines 150.

In performing the sensing driving operation, the dummy pixel may be the off pixel where an off current flows based on an off voltage. In the dummy pixel, a driving element may be turned off by the off voltage, and thus, the off current may denote panel noise. The dummy pixel may include a driving TFT DT, a plurality of switch TFTs ST1 and ST2, and a storage capacitor Cst and may not include a light emitting device. The dummy pixel may be the same as a case where the light emitting device EL is removed in FIG. 4. The dummy pixel may be merely used for sensing the panel noise and may be a pixel irrelevant to displaying an image.

In performing the sensing driving operation, the valid pixel may be the on pixel where an on current flows based on an on voltage. In the valid pixel, a driving element may be turned on by the on voltage, and thus, the on current may correspond to a pixel current where the panel noise occurs. A threshold voltage and electron mobility of the driving element included in the valid pixel and an operating point voltage of the light emitting device may be reflected in the pixel current. The valid pixel may be a pixel for displaying an image, and a circuit configuration thereof may be the same as FIG. 4.

The dummy sensing channel SCHx may be connected to a first current integrator CIx. The first current integrator CIx may sense the off current input through the dummy sensing channel SCHx to generate a dummy output voltage Va. The dummy output voltage Va may be a result obtained by sensing the off current. Power noise of the sensing circuit as well as the panel noise may be reflected in the dummy output voltage Va.

The valid sensing channel SCHy may be connected to a second current integrator CIy. The second current integrator CIy may sense the on current input through the valid sensing channel SCHy to generate a valid output voltage Vb. The valid output voltage Vb may be a result obtained by sensing the on current. The on current, the panel noise, and the power noise may be reflected in the valid output voltage Vb.

A sampling capacitor SCAP may be connected between an output terminal of the first current integrator CIx and an output terminal of the second current integrator CIy. One electrode of the sampling capacitor SCAP may be connected to the output terminal of the first current integrator CIx, and the other electrode of the sampling capacitor SCAP may be connected to the output terminal of the second current integrator CIy. The sampling capacitor SCAP may sample a difference voltage "Vb−Va" between the dummy output voltage Va and the valid output voltage Vb. A sampling voltage "Vb−Va" stored in the sampling capacitor SCAP may be a voltage obtained by removing the dummy output voltage Va, corresponding to the panel noise and the power noise, from the valid output voltage Vb, and thus, may be higher than the dummy output voltage Va and may be lower than the valid output voltage Vb.

Figure 7:
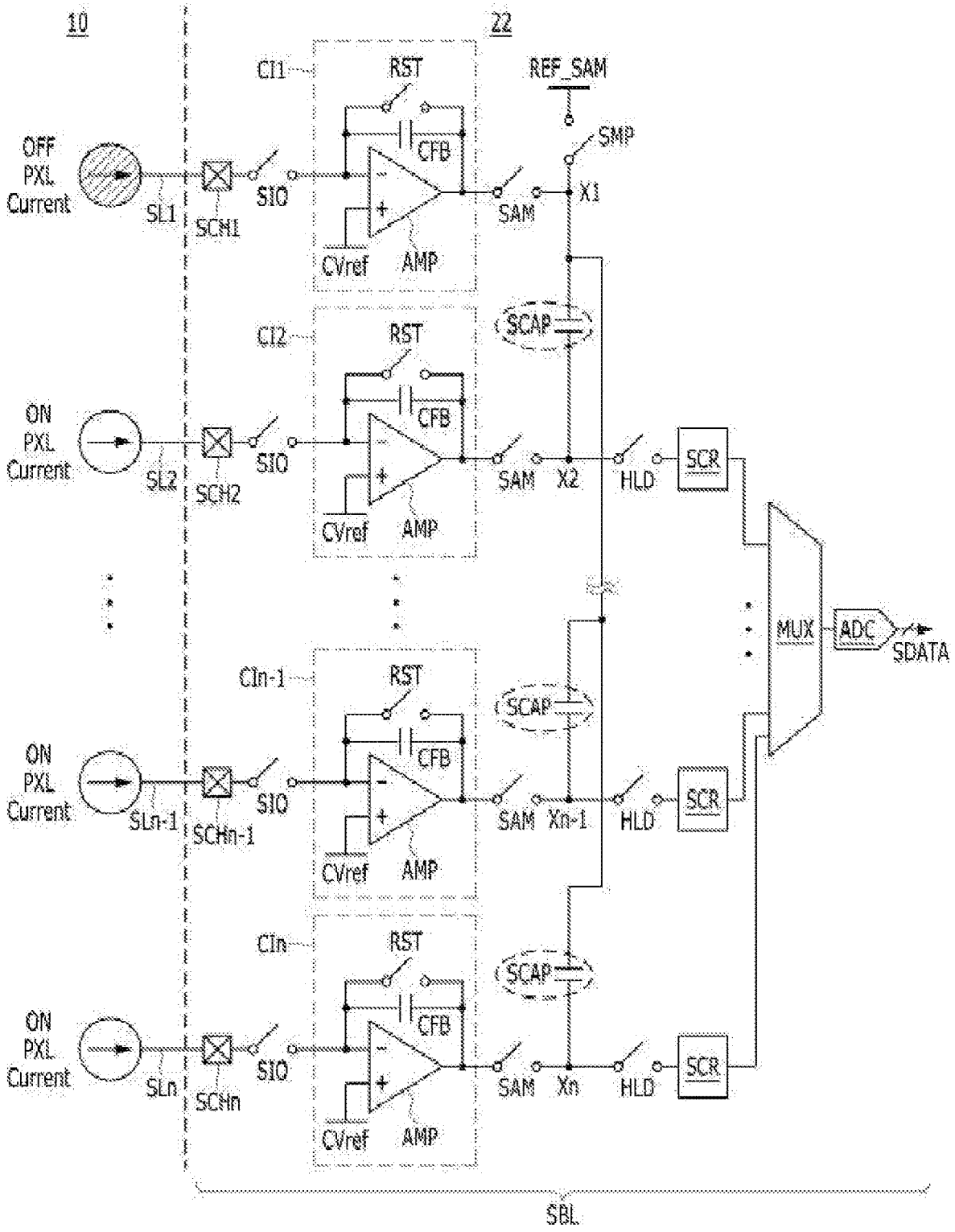
FIG. 7 is a diagram illustrating an example where a plurality of valid sensing channels share one dummy sensing channel in a sensing circuit according to a first embodiment.
Figure 8:
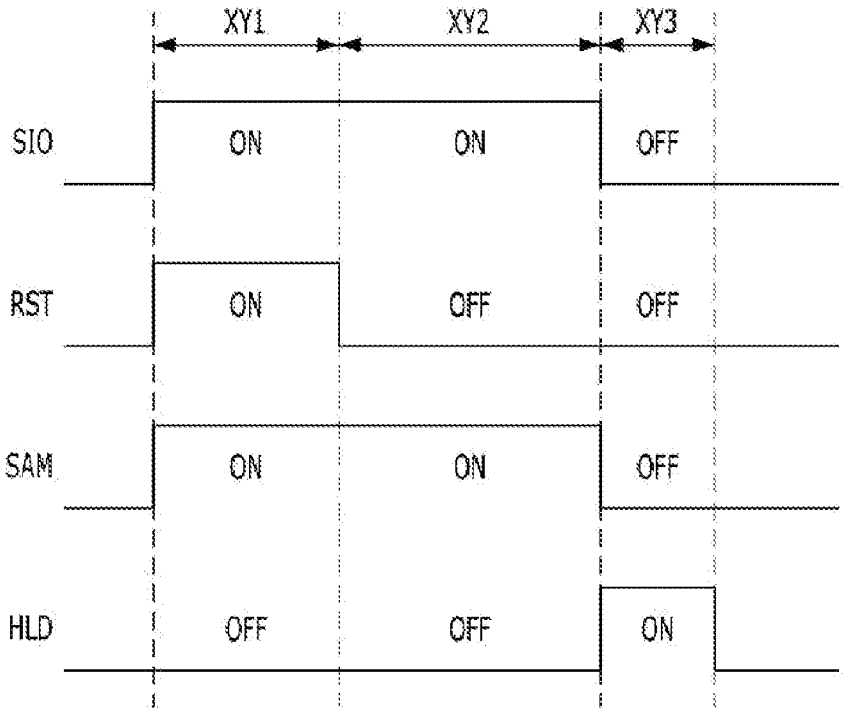
FIG. 8 is a diagram illustrating a driving timing of the sensing circuit of FIG. 7.

FIG. 7 is a diagram illustrating an example where a plurality of valid sensing channels share one dummy sensing channel in the sensing circuit according to the embodiment of FIG. 6. Also, FIG. 8 is a diagram illustrating a driving timing of the sensing circuit of FIG. 7.

Referring to FIG. 7, in first to $n^{th}$ sensing channels SCH1 to SCHn, the first sensing channel SCH1 may be a dummy sensing channel, and each of the second to $n^{th}$ sensing channels SCH2 to SCHn may be a valid sensing channel.

The first to $n^{th}$ sensing channels SCH1 to SCHn may be respectively connected to first to $n^{th}$ current integrators CI1 to CIn. A channel switch SIO may be connected between each sensing channel and each current integrator.

The first to $n^{th}$ current integrators CI1 to CIn may be designed in the same structure.

Each of the first to $n^{th}$ current integrators CI1 to CIn may be implemented with an integrator amplifier AMP, an integrator capacitor CFB, and a reset switch RST. The integrator amplifier AMP may include an inverting input terminal (−) connected to the channel switch SIO, a noninverting input terminal (+) receiving an integrator reference voltage CVref, and an output terminal for outputting an output voltage. The integrator capacitor CFB and the reset switch RST may be connected in parallel between the inverting input terminal (−) and the output terminal.

The integrator amplifier AMP may be implemented as a negative feedback type where the inverting input terminal (−) receives the off current or the on current. As the off current or the on current is accumulated into the integrator capacitor CFB through the inverting input terminal (−) of the integrator amplifier AMP, an output voltage of the integrator amplifier AMP may decrease from the integrator reference voltage CVref. A decrease slope of the output voltage may increase in proportion to a level of an integral-performed current.

An output terminal of the first current integrator CI1 connected to the first dummy sensing channel SCH1 may be connected to a dummy sampling node X1 through a sampling switch SAM, and output terminals of the second to $n^{th}$ current integrators CI2 to CIn respectively connected to the second to $n^{th}$ sensing channels SCH2 to SCHn may be connected to a plurality of valid sampling nodes X2 to Xn through the sampling switch SAM. The sampling capacitors SCAP may be connected between the dummy sampling node X1 and each of the valid sampling nodes X2 to Xn. Also, n−1 number of sampling capacitors SCAP may be provided to be respectively connected to the second to $n^{th}$ current integrators CI2 to CIn. Each of the sampling capacitors SCAP may perform a differential sampling operation on a valid output voltage from one of the valid sampling nodes X2 to Xn and a dummy output voltage from the dummy sampling node X1. The sampling capacitors SCAP may simultaneously perform the differential sampling operation to individually store a difference voltage (a sampling voltage) between the valid output voltage and the dummy output voltage. To this end, one electrode of each sampling capacitor SCAP may be connected to the dummy sampling node X1, and the other electrodes of the sampling capacitors SCAP may be respectively connected to the valid sampling nodes X2 to Xn.

A switch SMP for applying a sampling reference voltage REF_SAM may be further connected to the dummy sampling node X1 connected to one side of the sampling capacitor SCAP. The switch SMP may be turned on after the difference voltage between the valid output voltage and the dummy output voltage is sampled by the sampling capacitor SCAP, and thus, differential-sampled electric charges may be stably maintained in the sampling capacitor SCAP.

Each of the sampling nodes X1 to Xn may be connected to a scaler SCR through a holding switch HLD. The scaler SCR may perform down-scaling or up-scaling on a sampling voltage input through the holding switch HLD. The degree of down-scaling or up-scaling performed by the scaler SCR may be predetermined based on an operation range of an ADC.

Outputs of n−1 number of scalers SCR may be selectively input to the ADC through a multiplexer (MUX). The ADC may sequentially analog-digital-convert the outputs of the scalers SCR to output digital sensing data SDATA.

Operations of the sensing circuit 22 and the pixels of the display panel 10 in the sensing driving operation will be described below with reference to FIGS. 7 and 8.

In one sensing block, a sensing driving sequence may include an initialization period XY1, a sampling period XY2, a holding period XY3', and an output period XY3.

In the initialization period XY1, a plurality of channel switches SIO, a plurality of reset switches RST, and a plurality of sampling switches SAM may be turned on, and a plurality of holding switches HLD and the switch SMP may be turned off. In the initialization period XY1, the output terminal of the feedback capacitor CFB of each of the current integrators CI1 to CIn, each sampling capacitor SCAP, each of a plurality of sensing lines SL1 to SLn, a dummy pixel, and each valid pixel may be initialized to the integrator reference voltage CVref.

In the sampling period XY2, the plurality of channel switches SIO and the plurality of sampling switches SAM may maintain an on state, and the plurality of holding switches HLD and the switch SMP may maintain an off state. Also, the plurality of reset switches RST may be inverted from the on state to the off state.

In the sampling period XY2, the dummy pixel may output an off current to a first sensing line SL1 on the basis of an off voltage. The off current may be accumulated into the feedback capacitor CFB of a first current integrator CI1 and may be converted into a dummy output voltage. The dummy output voltage may be applied to the dummy sampling node X1 connected to one electrode of each of the sampling capacitors SCAP in common.

In the sampling period XY2, valid pixels may output the on current to second to $n^{th}$ sensing lines SL2 to SLn on the basis of the on voltage. The on current may be accumulated into the feedback capacitor CFB of each of second to $n^{th}$ current integrators CI2 to CIn and may be converted into valid output voltages. The valid output voltages may be applied to the valid sampling nodes X2 to Xn respectively connected to the other electrodes of the sampling capacitors SCAP.

In the sampling period XY2, each of the sampling capacitors SCAP may perform a differential sampling operation on the valid output voltage and the dummy output voltage and may store a sampling voltage from which noise has been removed.

In the holding period XY3', the switch SMP may be turned on, and the other switches may be turned off. In the holding period XY3', the sampling reference voltage REF_SAM may be applied to the dummy sampling node X1, and thus, the sampling voltage stored in each sampling capacitor SCAP may be stably maintained.

In the output period XY3, the switch SMP and the holding switches HLD may be turned on, and the other switches may be turned off. In the output period XY3, the sampling voltage stored in each sampling capacitor SCAP may be output to the scaler SCR through the holding switch HLD.

Figure 9:
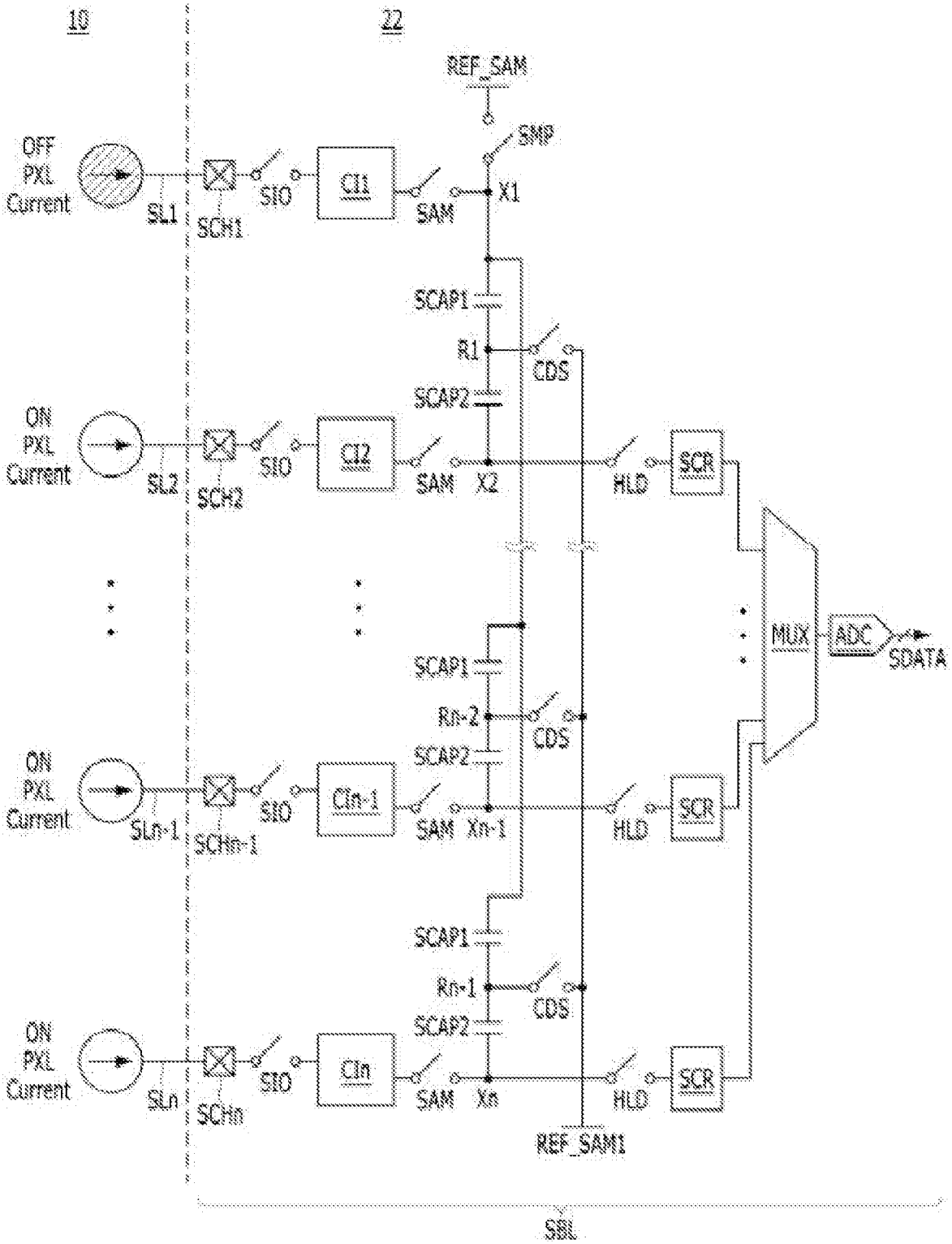
FIGS. 9 and 10 are diagrams illustrating a modification example where a plurality of valid sensing channels share one dummy sensing channel in a sensing circuit according to a first embodiment.
Figure 10:
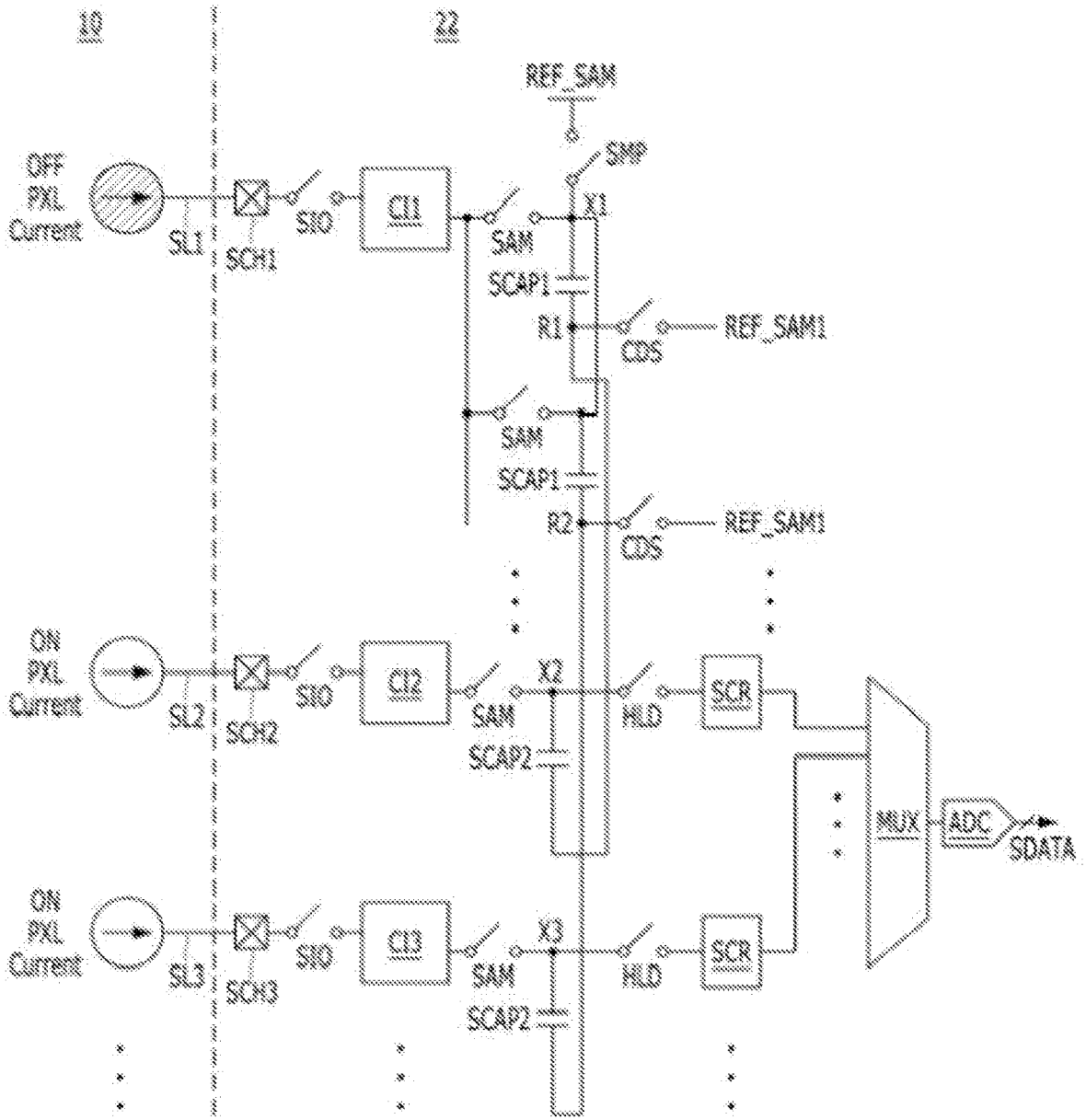
Figures 11, 12:
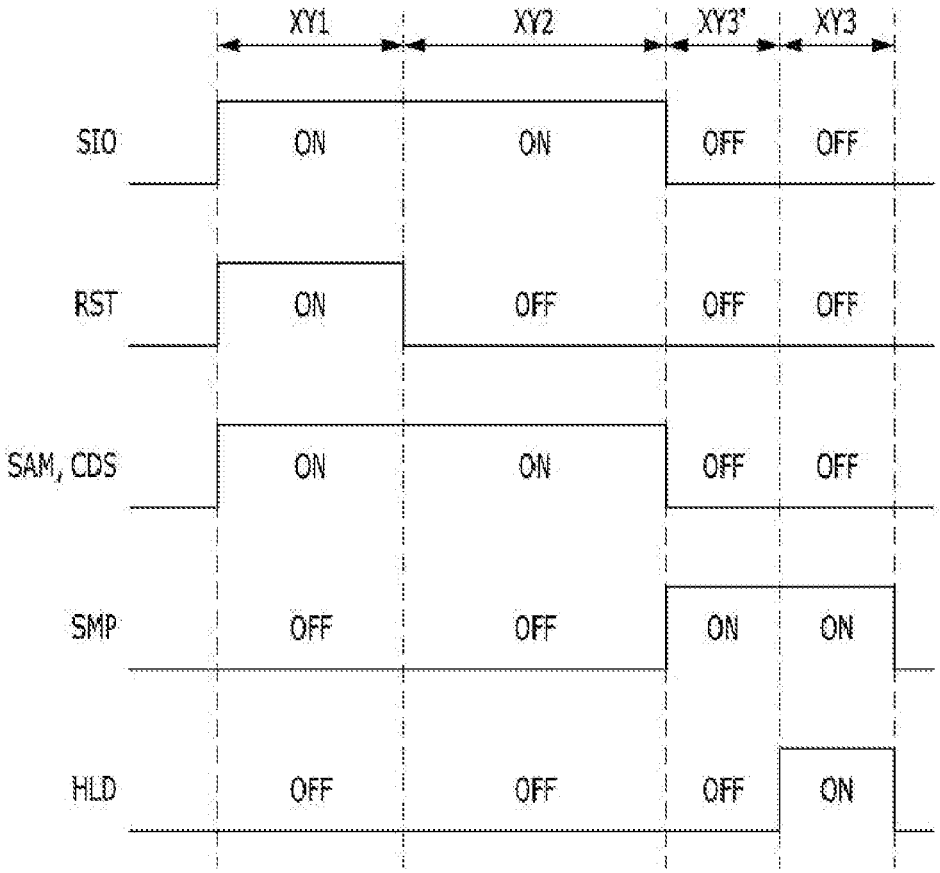
FIG. 11 is a diagram illustrating a driving timing of the sensing circuit of FIGS. 9 and 10.
FIG. 12 is a diagram illustrating an example where the number of elements included in the sensing circuit according to the first embodiment is reduced compared to the related art.

FIGS. 9 and 10 are diagrams illustrating a modification example where a plurality of valid sensing channels share one dummy sensing channel in a sensing circuit according to a first embodiment. Also, FIG. 11 is a diagram illustrating a driving timing of the sensing circuit of FIGS. 9 and 10.

Comparing with FIG. 7, FIG. 9 has a difference in that a sampling capacitor SCAP is divided into a first sampling capacitor SCAP1 and a second sampling capacitor SCAP2 and a differential sampling operation is implemented based on a method where the first sampling capacitor SCAP1 and the second sampling capacitor SCAP2 share an electric charge. The differential sampling operation may be performed on a dummy output voltage applied to the first sampling capacitor SCAP1 and a valid output voltage applied to the second sampling capacitor SCAP2. In order to stably perform the differential sampling operation, a first sampling reference voltage REF_SAM1 may be applied to a plurality of charge share nodes R1 to Rn−1 connected between the first sampling capacitor SCAP1 and the second sampling capacitor SCAP2. The first sampling reference voltage REF_SAM1 may be set to have the same level as that of the sampling reference voltage REF_SAM described above, or may be set to a level which differs from that of the sampling reference voltage REF_SAM. The first sampling capacitor SCAP1 and the second sampling capacitor SCAP2 may simultaneously perform a sampling operation on the first sampling reference voltage REF_SAM1 and may remove noise through charge sharing.

In detail, the first sampling capacitor SCAP1 may be connected between the dummy sampling node X1 and each of the charge share nodes R1 to Rn−1. The second sampling capacitor SCAP2 may be connected between the charge share nodes R1 to Rn−1 and the valid sampling nodes X2 to Xn. One of the charge share nodes R1 to Rn−1 may be allocated between the first sampling capacitor SCAP1 and the second sampling capacitor SCAP2, and each of the charge share nodes R1 to Rn−1 may be connected to an input terminal of the first sampling reference voltage REF_SAM1 through a switch CDS. The switch CDS, as in FIG. 11, may be turned on in synchronization with a timing at which the dummy output voltage is sampled by the first sampling capacitor SCAP1 and a timing at which the valid output voltage is sampled by the second sampling capacitor SCAP2.

The sensing circuit of FIG. 9 may be expressed as in FIG. 10. As seen in FIG. 10, a plurality of first sampling capacitors SCAP1 may be connected to the dummy sampling node X1. The plurality of first sampling capacitors SCAP1 may be respectively connected to a plurality of second sampling capacitors SCAP2, and thus, first and second sampling capacitor pairs SCAP1 and SCAP2 may simultaneously perform a sampling operation and a noise removing operation.

The other elements of FIGS. 9 and 10 may be substantially the same as the description of FIG. 7. Also, comparing with FIG. 8, a driving timing of FIG. 11 may further include a case where the switch CDS is turned on or off in synchronization with the sampling switch SAM. A driving timing of each of the other elements of FIG. 11 may be substantially the same as the description of FIG. 8.

FIG. 12 is a diagram illustrating an example where the number of elements included in the sensing circuit according to the first embodiment is reduced compared to the related art.

Referring to FIG. 12, in the electroluminescence display apparatus according to the first embodiment of the present disclosure, when it is assumed that 120 valid sensing channels are sensed for the same sensing time, the number of dummy sensing channels, the number of sampling capacitors (a case of FIG. 7), and the number of scalers may be considerably reduced compared to the related art, and thus, a logic size of a sensing circuit and the manufacturing cost may be largely reduced.

Second Embodiment

According to the second embodiment, sensing channels included in one sensing block may be simultaneously sampled once by using a sampling capacitor connected between each of valid sensing channels and a dummy sensing channel and noise-removed sampling voltages may be output, and thus, a size of a sensing circuit may decrease by about half without an increase in a sensing time, with respect to one sensing block. According to the second embodiment, one sensing channel among a plurality of sensing channels included in one sensing block may selectively be a dummy sensing channel, and sensing channels other than the dummy sensing channel may be valid sensing channels. A position of the dummy sensing channel may be changed by a switching operation of a selection switch at every certain time, and thus, in the second embodiment, a dummy pixel and a valid pixel may be designed in the same structure. Also, a position of the dummy pixel may be temporally changed, and thus, all pixels may be used to display an image.

Figure 13:
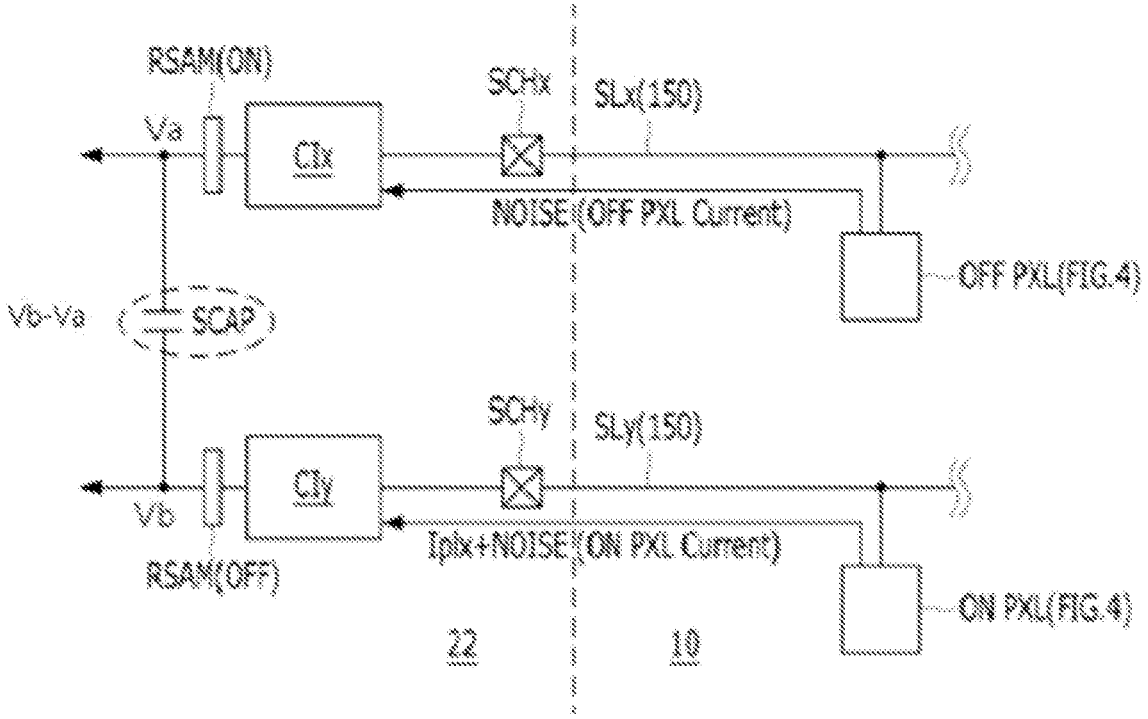
FIG. 13 is a schematic diagram of a connection configuration between a dummy sensing channel and a valid sensing channel in one sensing block, in a noise removing method according to a second embodiment.

FIG. 13 is a schematic diagram of a connection configuration between a dummy sensing channel and a valid sensing channel in one sensing block, in a noise removing method according to a second embodiment.

Referring to FIG. 13, a dummy sensing channel SCHx may be connected to a dummy pixel (an off pixel) through a dummy sensing line SLx, and the valid sensing channel SCHy may be connected to a valid pixel (an on pixel) through a valid sensing line SLy. The dummy sensing line SLx and the valid sensing line Sly may be different reference voltage supply lines 150.

In performing the sensing driving operation, the dummy pixel may be the off pixel where an off current flows based on an off voltage. In the dummy pixel, a driving element may be turned off by the off voltage, and thus, the off current may correspond to panel noise.

In performing the sensing driving operation, the valid pixel may be the on pixel where an on current flows based on an on voltage. In the valid pixel, a driving element may be turned on by the on voltage, and thus, the on current may correspond to a pixel current where the panel noise occurs. A threshold voltage and electron mobility of the driving element included in the valid pixel and an operating point voltage of the light emitting device may be reflected in the pixel current.

The dummy pixel and the valid pixel may be pixels for displaying an image, and a circuit configuration thereof may be the same as FIG. 4.

The dummy sensing channel SCHx may be connected to a first current integrator CIx. The first current integrator CIx may sense the off current input through the dummy sensing channel SCHx to generate a dummy output voltage Va. The dummy output voltage Va may be a result obtained by sensing the off current.

The valid sensing channel SCHy may be connected to a second current integrator CIy. The second current integrator CIy may sense the on current input through the valid sensing channel SCHy to generate a valid output voltage Vb. The valid output voltage Vb may be a result obtained by sensing the on current.

A sampling capacitor SCAP may be connected between an output terminal of the first current integrator CIx and an output terminal of the second current integrator CIy. One electrode of the sampling capacitor SCAP may be connected to the output terminal of the first current integrator CIx, and the other electrode of the sampling capacitor SCAP may be connected to the output terminal of the second current integrator CIy. The sampling capacitor SCAP may sample a difference voltage "Vb−Va" between the dummy output voltage Va and the valid output voltage Vb. A sampling voltage "Vb−Va" stored in the sampling capacitor SCAP may be a voltage obtained by removing the dummy output voltage Va, corresponding to the panel noise and the power noise, from the valid output voltage Vb, and thus, the sampling voltage "Vb−Va" may be higher than the dummy output voltage Va and may be lower than the valid output voltage Vb.

The selection switch RSAM having an on state may be connected between the output terminal of the first current integrator CIx and the sampling capacitor SCAP, and the selection switch RSAM having an off state may be connected between the output terminal of the second current integrator CIy and the sampling capacitor SCAP. A sensing channel where the selection switch RSAM is turned on may be a dummy sensing channel, and a sensing channel where the selection switch RSAM is turned off may be a valid sensing channel. In one sensing block, the number of turned-on selection switches RSAM may be one, and selection switches RSAM corresponding to the other sensing channels may be turned off. In one sensing block, a position of a turned-on selection switch RSAM may be changed at a certain-time period. When a position of a turned-on selection switch RSAM is changed, a position of a dummy sensing channel may be changed.

Figure 14:
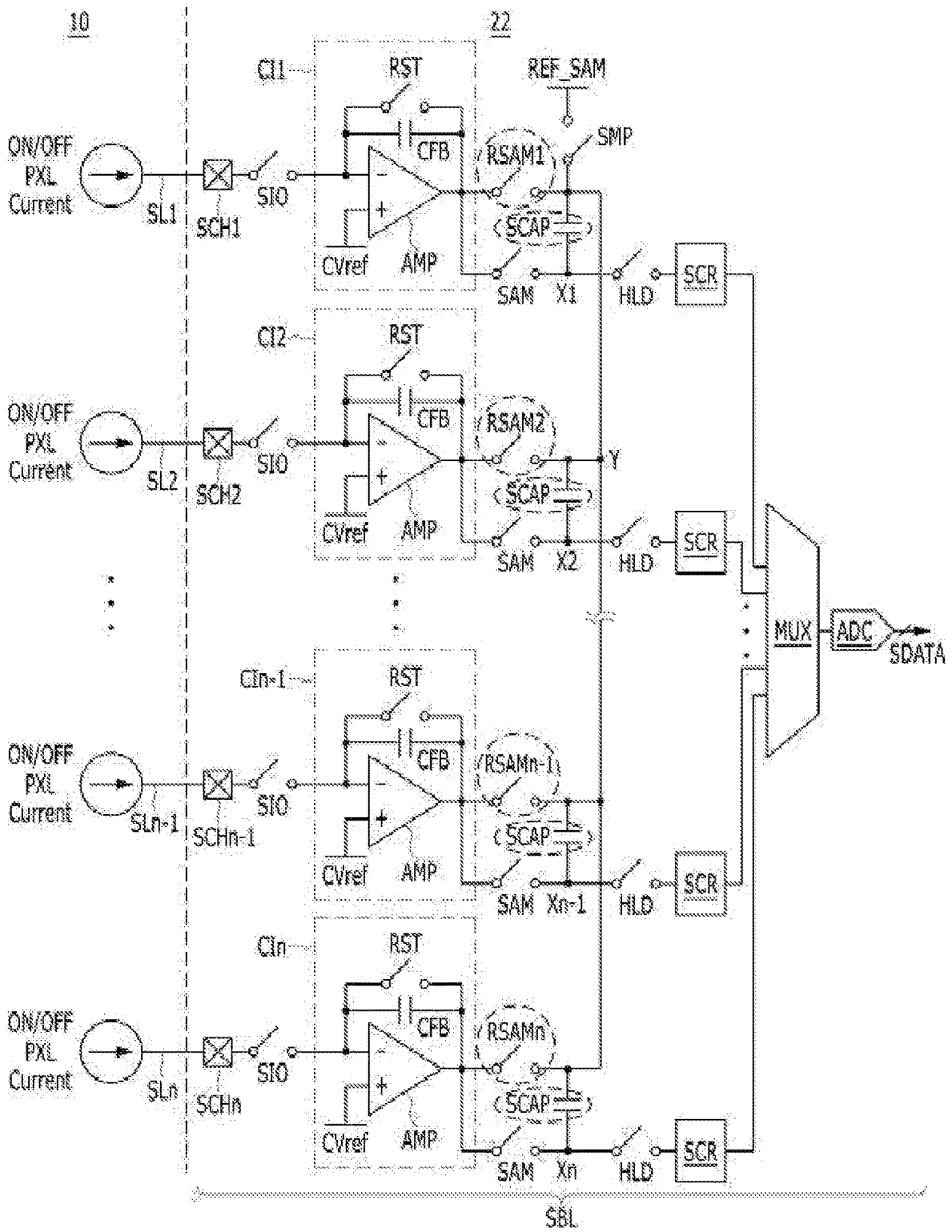
FIG. 14 is a diagram illustrating an example where a plurality of valid sensing channels share one dummy sensing channel in a sensing circuit according to a second embodiment.

FIG. 14 is a diagram illustrating an example where a plurality of valid sensing channels share one dummy sensing channel in a sensing circuit according to a second embodiment.

Referring to FIG. 14, in first to $n^{th}$ sensing channels SCH1 to SCHn, one sensing channel may be a dummy sensing channel, and sensing channels other than the dummy sensing channel may each be a valid sensing channel.

The first to $n^{th}$ sensing channels SCH1 to SCHn may be respectively connected to first to $n^{th}$ current integrators CI1 to CIn. A channel switch SIO may be connected between each sensing channel and each current integrator.

The first to $n^{th}$ current integrators CI1 to CIn may be designed in the same structure.

Each of the first to $n^{th}$ current integrators CI1 to CIn may be implemented with an integrator amplifier AMP, an integrator capacitor CFB, and a reset switch RST. The integrator amplifier AMP may include an inverting input terminal (−) connected to the channel switch SIO, a noninverting input terminal (+) receiving an integrator reference voltage CVref, and an output terminal for outputting an output voltage. The integrator capacitor CFB and the reset switch RST may be connected in parallel between the inverting input terminal (−) and the output terminal.

The integrator amplifier AMP may be implemented as a negative feedback type where the inverting input terminal (−) receives the off current or the on current. As the off current or the on current is accumulated into the integrator capacitor CFB through the inverting input terminal (−) of the integrator amplifier AMP, an output voltage of the integrator amplifier AMP may decrease from the integrator reference voltage CVref. A decrease slope of the output voltage may increase in proportion to a level of an integral-performed current.

Output terminals of the first to $n^{th}$ current integrators CI1 to CIn may be respectively connected to first to $n^{th}$ valid sampling nodes X1 to Xn through the sampling switch SAM. The output terminals of the first to $n^{th}$ current integrators CI1 to CIn may be connected to a share node Y through first to $n^{th}$ selection switches RSAM1 to RSAMn in common.

One selection switch of the first to $n^{th}$ selection switches RSAM1 to RSAMn may be turned on, and the other selection switches may be turned off. A sensing channel where a selection switch is turned on may be a dummy sensing channel, and sensing channels where a selection switch is turned off may be valid sensing channels. A sampling node connected to a dummy sensing channel may be a dummy sensing channel, and sampling nodes connected to valid sensing channels may be valid sampling nodes.

Moreover, n number of sampling capacitors SCAP may be connected between n number of sampling nodes X1 to Xn and the share node Y. Also, each of n−1 number of sampling capacitors SCAP may perform a differential sampling operation on a valid output voltage from a valid sampling node and a dummy output voltage from a dummy sampling node. The sampling capacitors SCAP may simultaneously perform the differential sampling operation to individually store a difference voltage (a sampling voltage) between the valid output voltage and the dummy output voltage. To this end, one electrode of each sampling capacitor SCAP may be connected to the share sampling node Y, and the other electrodes of the sampling capacitors SCAP may be respectively connected to the valid sampling nodes X1 to Xn.

A switch SMP for applying a sampling reference voltage REF_SAM may be further connected to the share node Y. The switch SMP may be turned on after a difference voltage between the valid output voltage and the dummy output voltage is sampled by the sampling capacitor SCAP, and thus, differential-sampled electric charges may be stably maintained in the sampling capacitor SCAP.

Each of the sampling nodes X1 to Xn may be connected to a scaler SCR through a holding switch HLD. The scaler SCR may perform down-scaling or up-scaling on a sampling voltage input through the holding switch HLD. The degree of down-scaling or up-scaling performed by the scaler SCR may be predetermined based on an operation range of an ADC.

Outputs of n number of scalers SCR may be selectively input to the ADC through a multiplexer (MUX). The ADC may sequentially analog-digital-convert the outputs of the scalers SCR to output digital sensing data SDATA.

Figure 15:
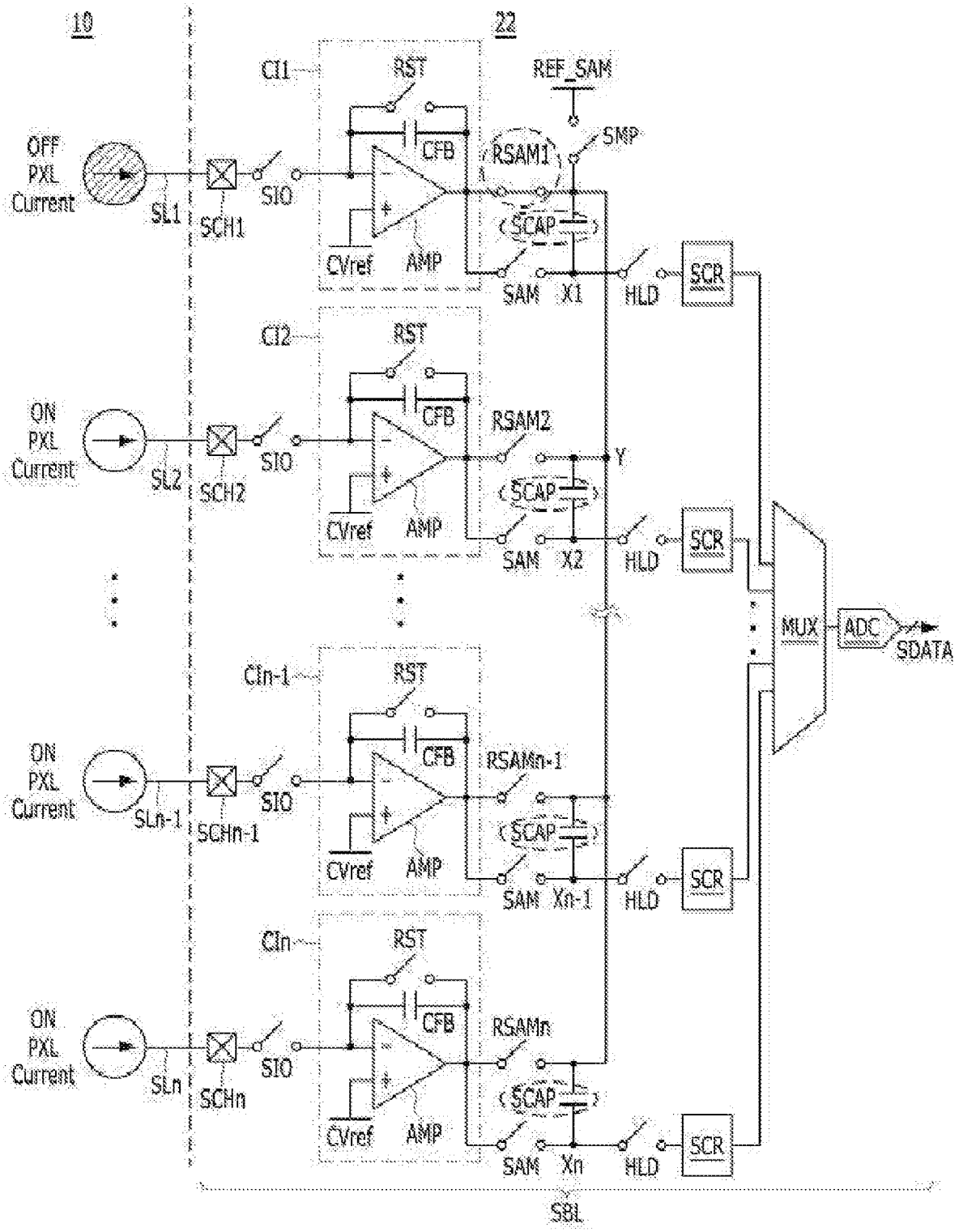
FIG. 15 is a diagram illustrating a case where a first sensing channel is selected as a dummy sensing channel and the other sensing channels are selected as valid sensing channels in FIG. 14.

FIG. 15 is a diagram illustrating a case where a first sensing channel is selected as a dummy sensing channel and the other sensing channels are selected as valid sensing channels in FIG. 14. Also, FIG. 16 is a diagram illustrating a driving timing of the sensing circuit of FIG. 15.

Referring to FIG. 15, a first selection switch RSAM1 may be turned on so that a first sensing channel SCH1 is selected as a dummy sensing channel, second to $n^{th}$ selection switches RSAM2 to RSAMn may be turned off so that second to $n^{th}$ sensing channels SCH2 to SCHn are selected as valid sensing channels, and an on/off state may be maintained during a sensing driving sequence of one period.

Figure 16:
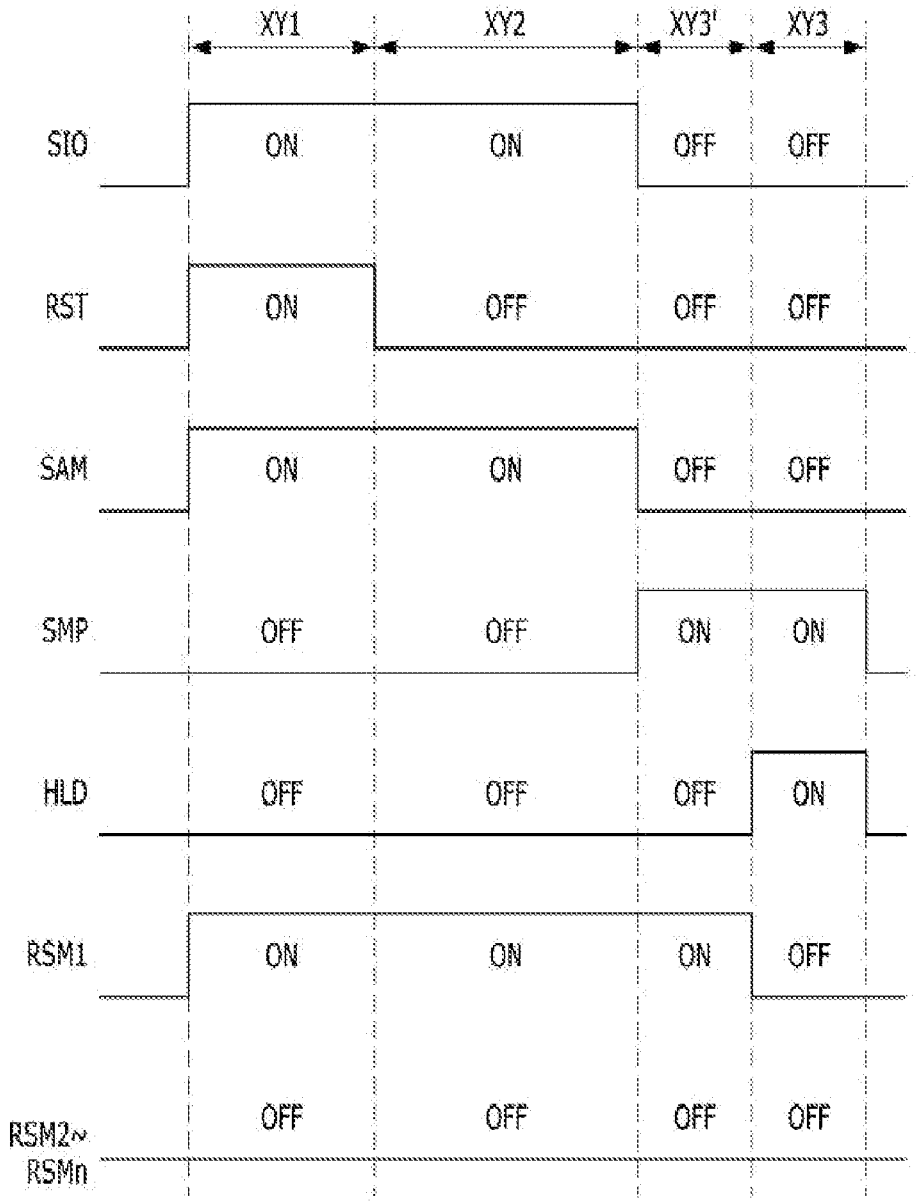
FIG. 16 is a diagram illustrating a driving timing of the sensing circuit of FIG. 15.

As in FIG. 16, in one sensing block, a sensing driving sequence may include an initialization period XY1, a sampling period XY2, a holding period XY3', and an output period XY3.

In the initialization period XY1, a plurality of channel switches SIO, a plurality of reset switches RST, and a plurality of sampling switches SAM may be turned on, and a plurality of holding switches HLD and a switch SMP may be turned off. In the initialization period XY1, the output terminal of a feedback capacitor CFB of each of a plurality of current integrators CI1 to CIn, each sampling capacitor SCAP, each of a plurality of sensing lines SL1 to SLn, a dummy pixel, and each valid pixel may be initialized to the integrator reference voltage CVref.

In the sampling period XY2, the plurality of channel switches SIO and the plurality of sampling switches SAM may maintain an on state, and the plurality of holding switches HLD and the switch SMP may maintain an off state. Also, the plurality of reset switches RST may be inverted from the on state to the off state.

In the sampling period XY2, the dummy pixel may output an off current to a first sensing line SL1 on the basis of an off voltage. The off current may be accumulated into a feedback capacitor CFB of a first current integrator CI1 and may be converted into a dummy output voltage. The dummy output voltage may be applied to one electrode of each of the sampling capacitors SCAP through a first selection switch RSAM1 and a share node Y in common.

In the sampling period XY2, valid pixels may output the on current to second to $n^{th}$ sensing lines SL2 to SLn on the basis of the on voltage. The on current may be accumulated into a feedback capacitor CFB of each of second to $n^{th}$ current integrators CI2 to CIn and may be converted into valid output voltages. The valid output voltages may be respectively applied to the other electrodes of the sampling capacitors SCAP through the sampling switches SAM.

In the sampling period XY2, each of the sampling capacitors SCAP may perform a differential sampling operation on the valid output voltage and the dummy output voltage and may store a sampling voltage from which noise has been removed.

In the holding period XY3', the switch SMP may be turned on, and the other switches may be turned off. In the holding period XY3', the sampling reference voltage REF_SAM may be applied to the share node Y, and thus, the sampling voltage stored in each sampling capacitor SCAP may be stably maintained.

In the output period XY3, the switch SMP and the holding switches HLD may be turned on, and the other switches may be turned off.

In the output period XY3, the sampling voltage stored in each sampling capacitor SCAP may be output to the scaler SCR through the holding switch HLD.

Figure 17:
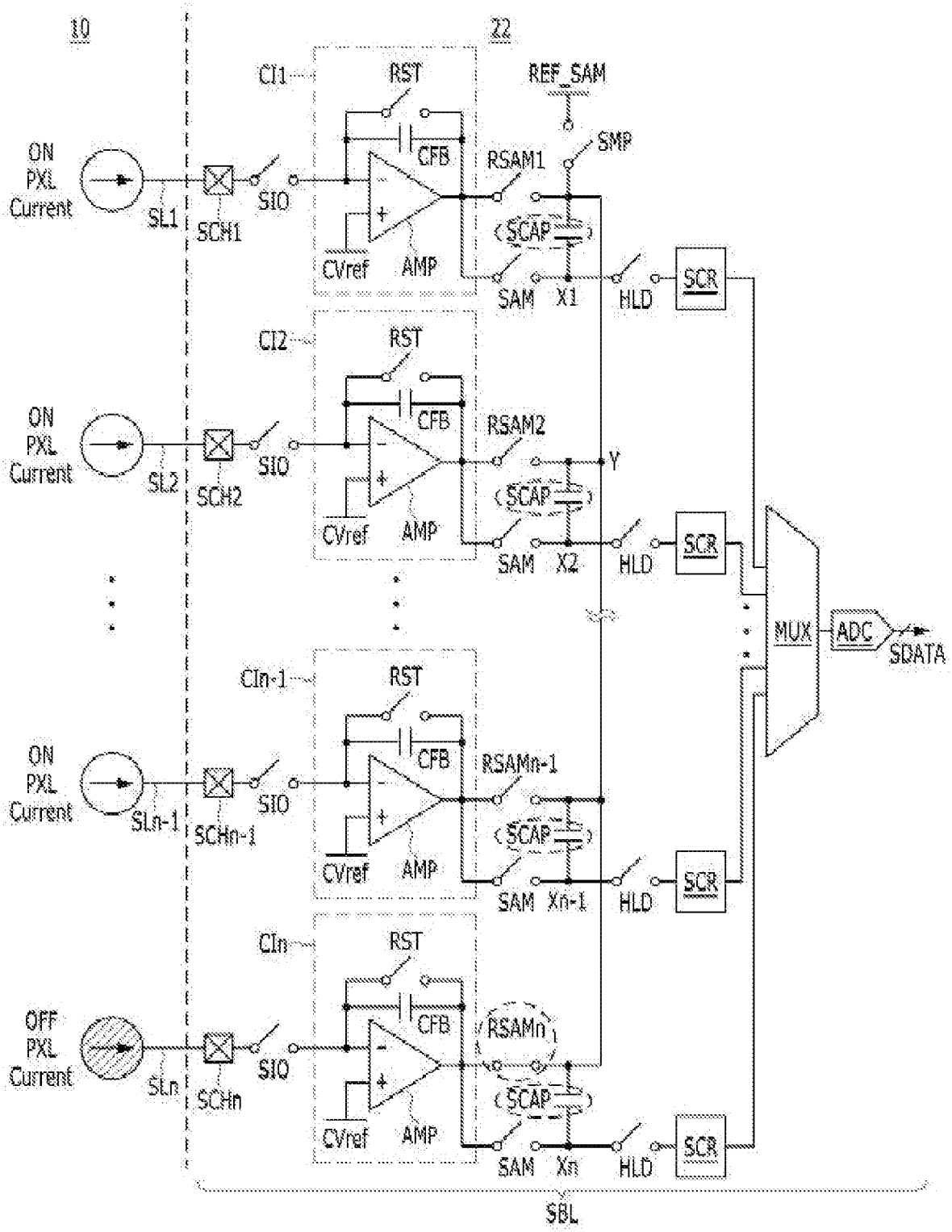
FIG. 17 is a diagram illustrating a case where a last sensing channel is selected as a dummy sensing channel and the other sensing channels are selected as valid sensing channels in FIG. 14.

FIG. 17 is a diagram illustrating a case where a last sensing channel is selected as a dummy sensing channel and the other sensing channels are selected as valid sensing channels in FIG. 14. Also, FIG. 18 is a diagram illustrating a driving timing of the sensing circuit of FIG. 17.

Referring to FIG. 17, an $n^{th}$ selection switch RSAMn may be turned on so that an $n^{th}$ sensing channel SCHn is selected as a dummy sensing channel, first to $n-1^{th}$ selection switches RSAM1 to RSAMn−1 may be turned off so that first to $n-1^{th}$ sensing channels SCH1 to SCHn−1 are selected as valid sensing channels, and an on/off state may be maintained during a sensing driving sequence of one period.

Figure 18:
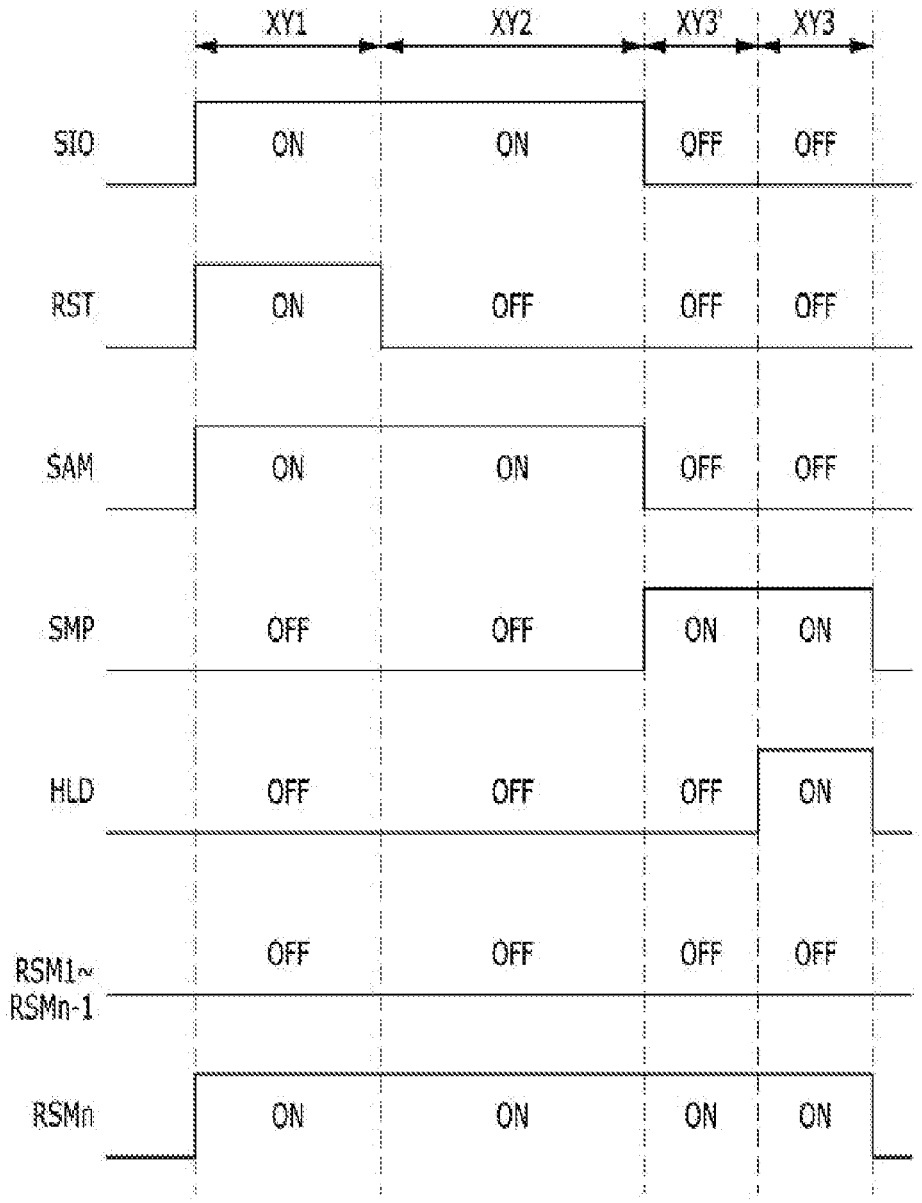
FIG. 18 is a diagram illustrating a driving timing of the sensing circuit of FIG. 17.

As in FIG. 18, in one sensing block, a sensing driving sequence may include an initialization period XY1, a sampling period XY2, a holding period XY3', and an output period XY3.

In the initialization period XY1, a plurality of channel switches SIO, a plurality of reset switches RST, and a plurality of sampling switches SAM may be turned on, and a plurality of holding switches HLD and a switch SMP may be turned off. In the initialization period XY1, an output terminal of a feedback capacitor CFB of each of a plurality of current integrators CD to CIn, each sampling capacitor SCAP, each of a plurality of sensing lines SL1 to SLn, a dummy pixel, and each valid pixel may be initialized to an integrator reference voltage CVref.

In the sampling period XY2, the plurality of channel switches SIO and the plurality of sampling switches SAM may maintain an on state, and the plurality of holding switches HLD and the switch SMP may maintain an off state. Also, the plurality of reset switches RST may be inverted from the on state to the off state.

In the sampling period XY2, the dummy pixel may output an off current to a first sensing line SL1 on the basis of an off voltage. The off current may be accumulated into a feedback capacitor CFB of an $n^{th}$ current integrator CIn and may be converted into a dummy output voltage. The dummy output voltage may be applied to one electrode of each of the sampling capacitors SCAP through an $n^{th}$ selection switch RSAMn and a share node Y in common.

In the sampling period XY2, valid pixels may output the on current to first to $n-1^{th}$ sensing lines SL1 to SLn−1 on the basis of the on voltage. The on current may be accumulated into a feedback capacitor CFB of each of first to $n-1^{th}$ current integrators CI1 to CIn−1 and may be converted into valid output voltages. The valid output voltages may be respectively applied to the other electrodes of the sampling capacitors SCAP through the sampling switches SAM.

In the sampling period XY2, each of the sampling capacitors SCAP may perform a differential sampling operation on the valid output voltage and the dummy output voltage and may store a sampling voltage from which noise has been removed.

In the holding period XY3', the switch SMP may be turned on, and the other switches may be turned off. In the holding period XY3', the sampling reference voltage REF_SAM may be applied to the share node Y, and thus, the sampling voltage stored in each sampling capacitor SCAP may be stably maintained.

In the output period XY3, the switch SMP and the holding switches HLD may be turned on, and the other switches may be turned off.

In the output period XY3, the sampling voltage stored in each sampling capacitor SCAP may be output to the scaler SCR through the holding switch HLD.

Figure 19:
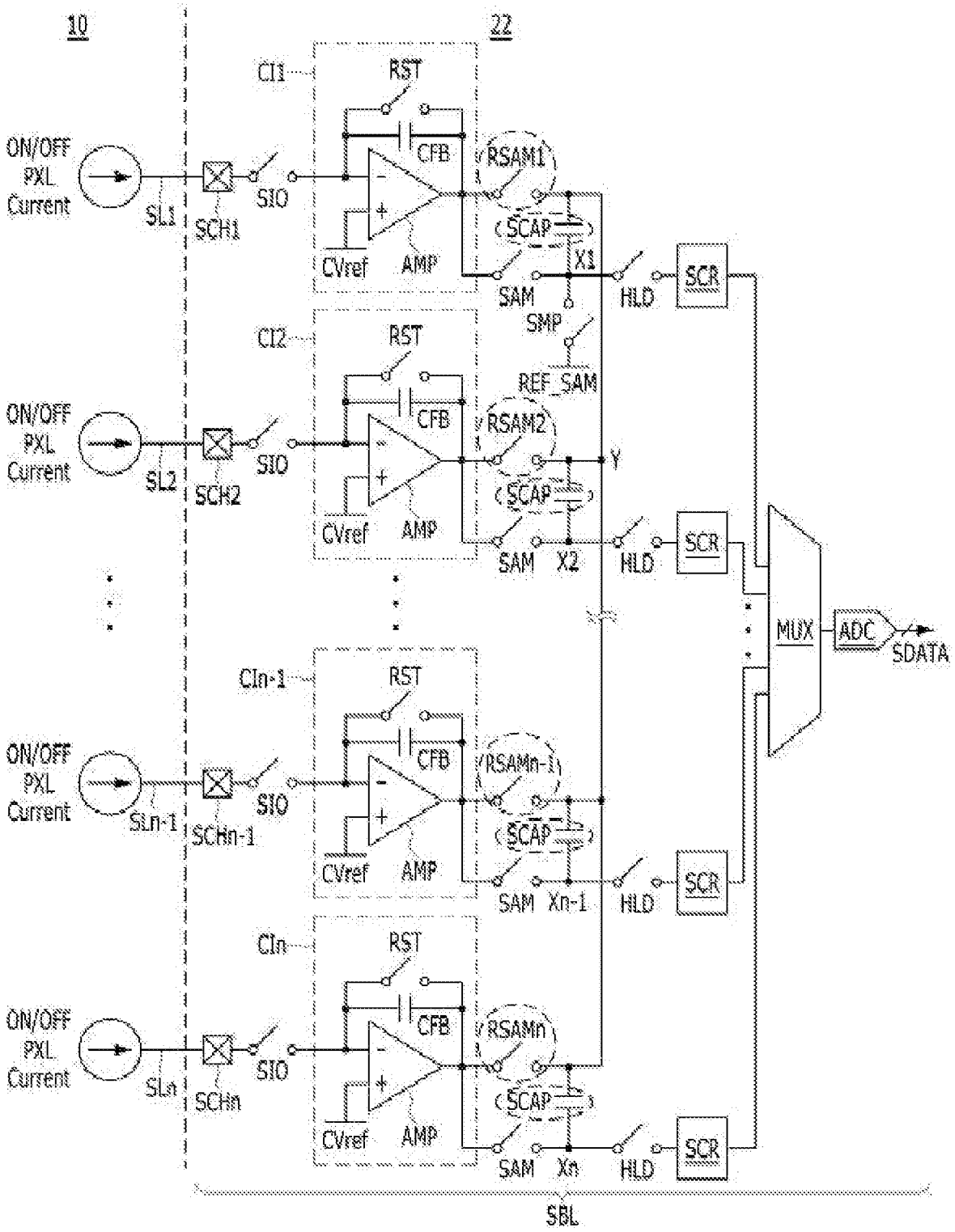
FIG. 19 is a diagram illustrating another example where a plurality of valid sensing channels share one dummy sensing channel in a sensing circuit according to a second embodiment.

FIG. 19 is a diagram illustrating another example where a plurality of valid sensing channels share one dummy sensing channel in a sensing circuit according to a second embodiment.

Referring to FIG. 19, a switch SMP for applying a sampling reference voltage REF_SAM may be further connected to a first sampling node X1 of a sampling capacitor SCAP. The switch SMP may be turned on after a difference voltage between a valid output voltage and a dummy output voltage is sampled by the sampling capacitor SCAP, and thus, differential-sampled electric charges may be stably maintained in the sampling capacitor SCAP.

In FIG. 19, elements other than a connection configuration between the sampling reference voltage REF_SAM and the switch SMP may be substantially the same as FIG. 14.

Figures 20, 21:
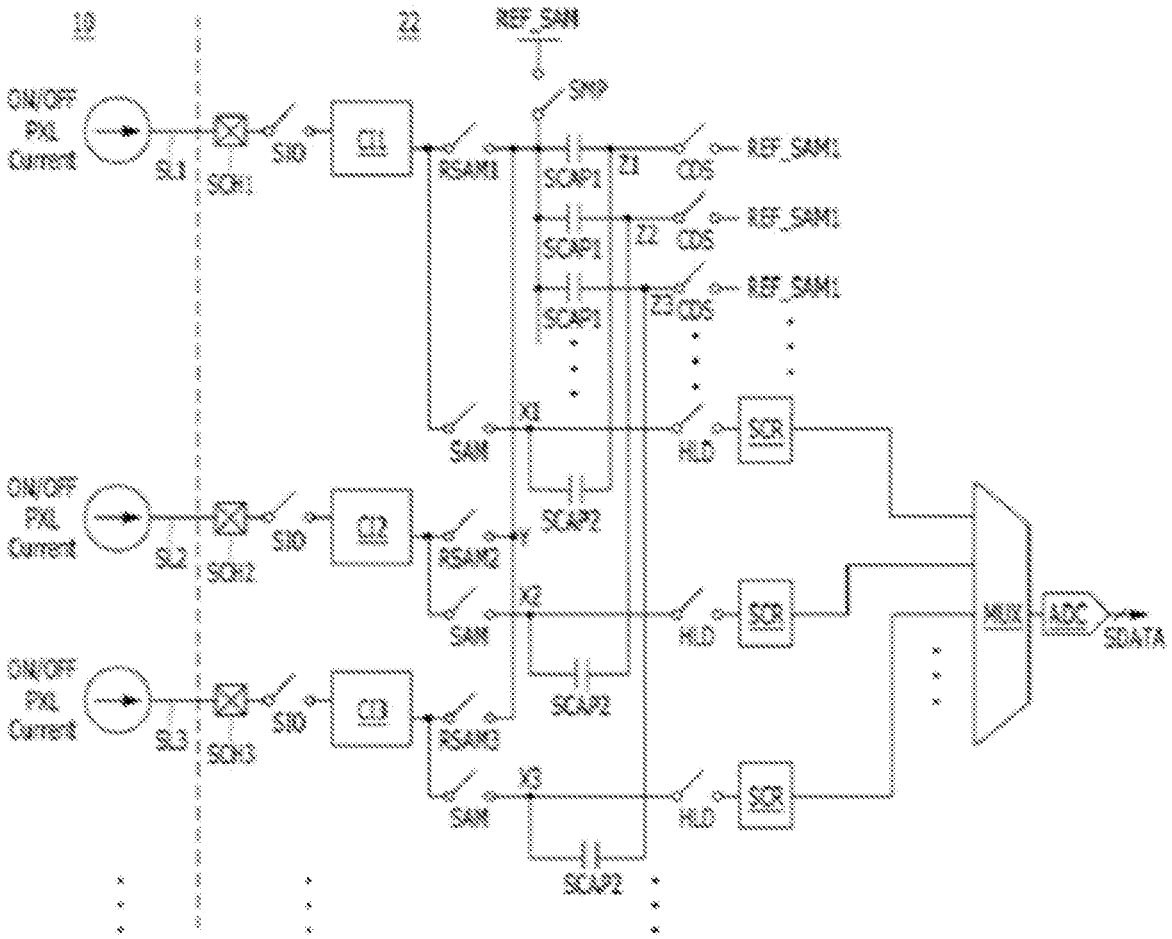
FIG. 20 is a diagram illustrating another example where a plurality of valid sensing channels share one dummy sensing channel in the sensing circuit according to the second embodiment.
FIG. 21 is a diagram illustrating an example where the number of elements included in the sensing circuit according to the second embodiment is reduced compared to the related art.

FIG. 20 is a diagram illustrating another example where a plurality of valid sensing channels share one dummy sensing channel in the sensing circuit according to the second embodiment.

Comparing with FIG. 14, FIG. 20 has a difference in that a sampling capacitor SCAP is divided into a first sampling capacitor SCAP1 and a second sampling capacitor SCAP2 and a differential sampling operation is implemented based on a method where the first sampling capacitor SCAP1 and the second sampling capacitor SCAP2 share an electric charge. The differential sampling operation may be performed on a dummy output voltage applied to the first sampling capacitor SCAP1 and a valid output voltage applied to the second sampling capacitor SCAP2. In order to stably perform the differential sampling operation, a first sampling reference voltage REF_SAM1 may be applied to a plurality of charge share nodes Z1 to Z3 connected between the first sampling capacitor SCAP1 and the second sampling capacitor SCAP2. The first sampling reference voltage REF_SAM1 may be set to have the same level as that of the sampling reference voltage REF_SAM described above, or may be set to a level which differs from that of the sampling reference voltage REF_SAM. The first sampling capacitor SCAP1 and the second sampling capacitor SCAP2 may simultaneously perform a sampling operation on the first sampling reference voltage REF_SAM1 and may remove noise through charge sharing.

In detail, the first sampling capacitor SCAP1 may be connected between a share node Y and each of the charge share nodes Z1 to Z3. The second sampling capacitor SCAP2 may be connected between the charge share nodes Z1 to Z3 and a plurality of valid sampling nodes X1 to X3. One of the charge share nodes Z1 to Z3 may be allocated between the first sampling capacitor SCAP1 and the second sampling capacitor SCAP2, and each of the charge share nodes Z1 to Z3 may be connected to an input terminal of the first sampling reference voltage REF_SAM1 through a switch CDS. The switch CDS may be turned on in synchronization with a timing at which the dummy output voltage is sampled by the first sampling capacitor SCAP1 and a timing at which the valid output voltage is sampled by the second sampling capacitor SCAP2. The switch SD may be turned on/off at the same timing as the sampling switch SAM.

A plurality of first sampling capacitors SCAP1 may be connected to the share node Y. The plurality of first sampling capacitors SCAP1 may be respectively connected to a plurality of second sampling capacitors SCAP2, and thus, first and second sampling capacitor pairs SCAP1 and SCAP2 may simultaneously perform a sampling operation and a noise removing operation.

The other elements of FIG. 20 may be substantially the same as the descriptions of FIG. 14. A driving timing of FIG. 20 may be described with reference to FIGS. 16 and 18.

FIG. 21 is a diagram illustrating an example where the number of elements included in the sensing circuit according to the second embodiment is reduced compared to the related art.

Referring to FIG. 21, in the electroluminescence display apparatus according to the second embodiment of the present disclosure, when it is assumed that 120 valid sensing channels are sensed for the same sensing time, the number of dummy sensing channels, the number of sampling capacitors (a case of FIG. 14), and the number of scalers may be considerably reduced compared to the related art, and thus, a logic size of a sensing circuit and the manufacturing cost may be largely reduced.

As described above, the electroluminescence display apparatus according to the embodiments of the present disclosure may remove noise by using a sampling capacitor of a sensing circuit, and thus, may increase sensing performance and compensation performance.

In the electroluminescence display apparatus according to the embodiments of the present disclosure, a plurality of valid sensing channels may share one dummy sensing channel for sensing noise and noise may be removed by using the sampling capacitor connected between each of the valid sensing channels and the dummy sensing channel, and thus, a sensing time may not increase and a size of a sensing circuit and the manufacturing cost may be considerably reduced.

The effects according to the present disclosure are not limited to the above examples, and other various effects may be included in the specification.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An electroluminescence display apparatus comprising:

a display panel including a first pixel and a second pixel;

a first current integrator coupled to the first pixel through a first sensing channel to sense a first current from the first pixel, the first current integrator configured to generate a first output voltage based on the first current from the first pixel;

a second current integrator coupled to the second pixel through a second sensing channel to sense a second current from the second pixel, the second current integrator configured to generate a second output voltage based on the second current from the second pixel; and a sampling capacitor including a first electrode and a second electrode, the first electrode of the sampling capacitor coupled to an output terminal of the first current integrator and the second electrode of the sampling capacitor coupled to an output terminal of the second current integrator;

wherein a sampling voltage stored in the sampling capacitor is higher than a dummy output voltage, the sampling voltage being one of the first output voltage or the second output voltage, and is lower than a valid output voltage which is the other of the first output voltage or the second output voltage.

2. The electroluminescence display apparatus of claim 1, wherein the sampling capacitor is configured to sample a difference voltage between the first output voltage and the second output voltage.

3. The electroluminescence display apparatus of claim 2, further comprising a first switch applying a sampling reference voltage to a dummy sampling node coupled to one side of the sampling capacitor, wherein the first switch is turned on after the difference voltage between the first output voltage and the second output voltage is sampled by the sampling capacitor.

4. The electroluminescence display apparatus of claim 3, further comprising a second switch applying a first sampling reference voltage to a first charge share node, wherein the sampling capacitor includes:

a first sampling capacitor coupled between the dummy sampling node and the first charge share node; and a second sampling capacitor coupled between the first charge share node and a valid sampling node coupled to the output terminal of the second current integrator, and the second switch is turned on in synchronization with a timing at which the first output voltage is sampled by the first sampling capacitor and a timing at which the second output voltage is sampled by the second sampling capacitor.

5. The electroluminescence display apparatus of claim 4, wherein the sampling capacitor includes two of more first sampling capacitors including the first sampling capacitor coupled between the dummy sampling node and the first charge share node, the two of more first sampling capacitors are coupled to the dummy sampling node in common.

6. The electroluminescence display apparatus of claim 1, wherein the sampling voltage is a voltage obtained by subtracting the dummy output voltage from the valid output voltage.

7. The electroluminescence display apparatus of claim 1, wherein one of the first current or the second current is an on current, and the other of the first current or the second current is an off current.

8. The electroluminescence display apparatus of claim 7, wherein the valid output voltage is a result obtained by sensing the on current, and wherein the dummy output voltage is a result obtained by sensing the off current.

9. The electroluminescence display apparatus of claim 7, wherein a sensing channel receiving the off current is a dummy sensing channel, and wherein a sensing channel receiving the on current is a valid sensing channel.

10. The electroluminescence display apparatus of claim 9, wherein the dummy sensing channel is fixed to one of the first sensing channel or the second sensing channel, and wherein the valid sensing channel is fixed to the other of the first sensing channel or the second sensing channel.

11. The electroluminescence display apparatus of claim 10, wherein a pixel coupled to the valid sensing channel includes a driving element configured to generate the on current and a light emitting device, and wherein a pixel coupled to the dummy sensing channel includes a driving element configured to generate the off current and does not include a light emitting device.

12. The electroluminescence display apparatus of claim 10, wherein, in one block, the number of dummy sensing channels is one, and the valid sensing channel is provided in plurality.

13. The electroluminescence display apparatus of claim 9, wherein one of the first sensing channel or the second sensing channel is selected as the dummy sensing channel and the other of the first sensing channel or the second sensing channel is selected as the valid sensing channel, and wherein each of the first sensing channel and the second sensing channel is switched from being the dummy sensing channel to being the valid sensing channel or from being the valid sensing channel to being the dummy sensing channel at a certain period.

14. The electroluminescence display apparatus of claim 13, wherein a pixel coupled to the valid sensing channel includes a first light emitting device and a driving element that generates the on current, and a pixel coupled to the dummy sensing channel includes a second light emitting device and a driving element that generates the off current.

15. The electroluminescence display apparatus of claim 13, further comprising:

a first selection switch coupled between the output terminal of the first current integrator and a share node of the sampling capacitor; and a second selection switch coupled between the output terminal of the second current integrator and the share node of the sampling capacitor.

16. The electroluminescence display apparatus of claim 15, wherein the first selection switch and the second selection switch are selectively turned on.

17. The electroluminescence display apparatus of claim 15, further comprising a first switch applying a sampling reference voltage to the share node, wherein the first switch is turned on after the difference voltage between the first output voltage and the second output voltage is sampled by the sampling capacitor.

18. The electroluminescence display apparatus of claim 15, further comprising a first switch applying a sampling reference voltage to a first sampling node of the sampling capacitor, wherein the first switch is turned on after the difference voltage between the first output voltage and the second output voltage is sampled by the sampling capacitor.

19. The electroluminescence display apparatus of claim 15, further comprising a second switch applying a first sampling reference voltage to a first charge share node, wherein the sampling capacitor includes:

a first sampling capacitor coupled between the share node of the sampling capacitor and the first charge share node; and a second sampling capacitor coupled between the first charge share node and a first sampling node of the sampling capacitor, and the second switch is turned on in synchronization with a timing at which the first output voltage is sampled by the first sampling capacitor and a timing at which the second output voltage is sampled by the second sampling capacitor.

20. The electroluminescence display apparatus of claim 19, wherein a plurality of first sampling capacitors are coupled to the share node in common.

21. The electroluminescence display apparatus of claim 13, wherein, in one block, the number of dummy sensing channels is one, and the valid sensing channel is provided in plurality.

* * * * *